US005375501A

United States Patent [19]

Okuda

[11] Patent Number: 5,375,501

[45] Date of Patent: Dec. 27, 1994

[54] AUTOMATIC MELODY COMPOSER

[75] Inventor: Hiroko Okuda, Kokubunji, Japan

[73] Assignee: Casio Computer Co., Ltd., Tokyo, Japan

[21] Appl. No.: 998,577

[22] Filed: Dec. 29, 1992

[30] Foreign Application Priority Data

Dec. 30, 1991 [JP] Japan ..... 3-360547

[51] Int. Cl.[5] ..... G10H 1/40

[52] U.S. Cl. ..... 84/611; 84/DIG. 12

[58] Field of Search ..... 84/609-614, 84/DIG. 12

[56] References Cited

U.S. PATENT DOCUMENTS 4,399,731 8/1983 Aoki .
4,664,010 5/1987 Sestero .
4,926,737 5/1990 Minamitaka .
5,099,740 3/1992 Minamitaka .
5,218,153 6/1993 Minamitaka ..... 84/613

FOREIGN PATENT DOCUMENTS 62-187876 8/1987 Japan .
WO86/05616 9/1986 WIPO .

*Primary Examiner*—Stanley J. Witkowski
*Attorney, Agent, or Firm*—Frishauf, Holtz, Goodman & Woodward

[57] ABSTRACT

An automatic melody composer composes a melody on a phrase by phrase basis. A phrase database storage stores data of many and various phrases. A generating index database storage stores records of music generating index. Each record describes or indicates appropriate phrases in the phase database and how melody is modified or developed in moving from one musical time unit to another. A decoder selects an index record from the generating index database, retrieves, from the phrase database, phrase components according to the index record, and combines them into a phrase. Thus, the composer quickly provides a natural melody formed with a chain of phrases without requiring complicated data processing.

8 Claims, 46 Drawing Sheets

RCL

| FORM | REF RHYTHM |
|---|---|
| A'-1 | A |
| A'-2 | A |
| A'-3 | A |
| A'-4 | A |
| B-1 | B |
| B-2 | B |
| B-3 | B |
| B-4 | B |
| B'-1 | C |
| B'-2 | C |
| B'-3 | C |
| B'-4 | C |
| C-1 | D |
| C-2 | D |
| C-3 | D |
| C-4 | D |
| C'-1 | E |
| C'-2 | E |
| C'-3 | E |
| C'-4 | E |

FIG.6

RHYTHM TABLE, RPD

| RLB OLD RHYTHM PATTERN | RC RHYTHM INDEX | REF RHYTHM PATTERN RLM | | | | | | | |
|---|---|---|---|---|---|---|---|---|---|
| | | A | B | C | D | E | F | G | H |
| | 1a | | | | | | | | |
| | 1b | | | | | | | | |
| | 1c | | | | | | | | |
| | 1d | | | | | | | | |
| | 2a | | | | | | | | |
| | 2b | | | | | | | | |
| | 2c | | | | | | | | |
| | 2d | | | | | | | | |
| | 3a | | | | | | | | |
| | 3b | | | | | | | | |
| | 3c | | | | | | | | |
| | 3d | | | | | | | | |
| | 1a | | | | | | | | |
| | 1b | | | | | | | | |
| | 1c | | | | | | | | |

FIG.7

NOTE TYPE SUCCESSION TABLE, NCD

| TRD CURRENT RHYTHM ID | NC PITCH INDEX | NOTE TYPE SUCCESSION |
|---|---|---|
| | 1a | +k1,+k2,+st4,+k3,+st4,+k2 |
| | 1b | -k4,-st6,-k4,+k1,-st6,+k1 |
| | 1c | +k1,+k2,+st2,+k2,+st2,+k1 |
| | 1d | -k1,+st4,+k2,-k4,-st6,-k3 |
| | ⋮ | ⋮ |
| | 1a | +k2,+k1 |
| | 1b | -k3,+k1 |
| | 1c | +k1,+k2 |
| | ⋮ | ⋮ |
| | 1a | +st2,+k3,+k2,+k1 |
| | 1b | -st6,-k3,-k2,-k3 |
| | 1c | +st2,+k3,+k1,+k2 |
| | ⋮ | ⋮ |

FIG.8

| | k 1 | st2 | k 2 | st4 | k 3 | st6 | k 4 | TONAL HARMONY |
|---|---|---|---|---|---|---|---|---|
| Ionian | C | D | E | F | G | A | B | major I |
| Ionian | C | D | E | F | G | A | B | major7 I |
| Dorian | C | D | D # | F | G | A | A # | minor II |
| Dorian | C | D | D # | F | G | A | A # | m7 II |
| Phrigyan | C | C # | D # | F | G | G # | A # | minor III |
| Phrigyan | C | C # | D # | F | G | G # | A # | m7 III |
| Lydian | C | D | E | F # | G | A | B | Major IV |
| Lydian | C | D | E | F # | G | A | B | Major7 IV |
| Mixolydian | C | D | E | F | G | A | A # | Major V |
| Mixolydian | C | D | E | F | G | A | A # | Major V |
| Mixolydian(7Sus) | C | D | F | F | G | A | A # | 7Sus V |
| Aeorian | C | D | D # | F | G | G # | A # | m7 VI |
| Locrian | C | C # | D # | F | F # | G # | A # | m7b5 VII |
| Melodic Minor | C | D | D # | F | G | A | B | Minor IV,Minor VI |
| Melodic Minor | C | D | D # | F | G | A | B | mM7 IV,mM7 VI |
| Melodic Minor 5th below | C | D | E | F | G | G # | A # | Major III |
| Melodic Minor 5th below | C | D | E | F | G | G # | A # | 7 III |
| Melodic m-5th(7Sus) | C | D | F | F | G | G # | A # | 7Sus4 III |
| Melodic Minor 6th below | C | D | D # | F | F # | G # | A # | m7b5 II |
| Whole Tone | C | D | E | E | F # | G # | A # | Aug |
| Diminished | C | D | D # | F | F # | G # | A | dim |
| Sus4 | C | D | F | F | G | G | C(up) | Sus4 |

PITCH CLASS TRANSLATION TABLE, AV

FIG.9

PC TRASLATION TABLE AV

| R-ADDR | DATA |
|---|---|
| 0 | PC DATA OF K1 |
| 1 | PC DATA OF K2 |
| 2 | PC DATA OF K3 |
| 3 | PC DATA OF K4 |
| 4 | PC DATA OF st2 |
| 5 | PC DATA OF st4 |
| 6 | PC DATA OF st6 |
| ⋮ | ⋮ |

TONALITY RECORD ADDRESS
=(TONAL FROM CEDx7)+START ADDRESS AV

FIG.35

AUTOMATIC MELODY COMPOSER

BACKGROUND OF THE INVENTION

1. Field of the Invention

This invention relates to musical apparatus. In particular, the invention pertains to an automatic composer which automatically composes melody.

2. Description of the Prior Art

Several automatic composers are known which automatically compose a melody. Examples are disclosed in U.S. Pat. Nos. 4,399,731, 4,554,010, WO No. 86/05616 and Japanese patent application laid-open SHO62/187876.

The automatic composer of U.S. Pat. No. 4,399,731 uses trial-and-error method which generates random numbers to compose a melody note pitch succession. Thus, the composer has an infinite space of melody composing but lacks knowledge or art of music composition so that the chance of getting a good melody as too low.

Each automatic composer of U.S. Pat. No. 4,564,010 and WO No. 86/05616 is a melody composer or transformer which transforms a given melody. The melody transformation involves a mathematical operation (mirror transformation of a pitch succession, linear transformation of a two dimensional space of pitch and durational series). With a limited space of the transformation, the composer has only a fixed and mathematical (rather than musical) capability of melody composition. Japanese patent application laid-open 62/187876 discloses a melody composer which utilizes a Markov chain model to generate a pitch succession. The apparatus composes a melody based on a pitch transit ion table indicative of a Markov chain of a pitch succession. The composed melody has a musical style of the pitch transition table. While it can compose a musical melody at a relatively high efficiency, the composer provides a small space of melody composition since the composed melody style is limited.

Common disadvantages of the prior art described above are (1) no contemplation of musical background or progression (e.g., musical style, structure, chord progression)

(2) no capability of analyzing or evaluating a melody, and thus (3) low capability of composing a musical melody.

In view of these, an automatic composer has been proposed which aims at human-like (rather than mechanical) music composing, as disclosed in U.S. Pat. Nos. 4,926,737 and 5,099,740 (a division U.S. Pat. No. 4,926,737), each assigned to the present assignee. The automatic composer has a stored knowledge-base of melody which classifies nonharmonic tones by their relationship formed with harmonic tones based on the premise that a melody is a mixed succession of harmonic and nonharmonic tones. The stored knowledge-base of nonharmonic tone classification is used analyze a melody (motive) supplied by a user is also used to compose or synthesize a melody (phrase succession) following the motive. Further, the automatic composer discloses a phrase rhythm generator which generates a rhythm of a phrase by modifying the original rhythm (motive rhythm). The rhythm modification involves inserting and/or deleting note-on timings into or from the original rhythm according to rhythm control data called pulse scale having weights for individual timings in a musical time interval such as a measure. Where it can compose a musical melody reflecting a feature of the motive, the automatic composer has the following disadvantages.

(A) It requires a large amount of data to be processed for musical composition (B) Thus, the response is slow. When implemented on a computer of limited performance, the automatic composer composes a melody in non-real time.

(C) Limited capability of generating rhythm patterns. It is difficult to make those rhythm patterns having the same note number but different in a subtle way from one another.

(D) The automatic composer requires complicated algorithmic operations to generate a phrase idea (phrase featuring parameters) for developing or modifying the input motive.

(E) Nevertheless, a composed melody often involves unnaturalness peculiar to the algorithm.

SUMMARY OF THE INVENTION

It is therefore, an object of the invention to provide an automatic melody composer capable of composing natural and various melodies without requiring complicated processing of large amounts of data or time-consuming algorithmic operations.

In accordance with the invention, there is provided an automatic melody composer which composes a melody on a phrase by phrase basis. The melody extends over a plurality of musical time units. The term "phrase" refers to a melody segment in an individual musical time unit. The automatic melody composer comprises phrase database means for storing a phrase database in terms of musical components of phrase, generating index storage means for storing generating indexes of phrases in individual musical time units, arranged so as to control (composing of) a melody extending over a plurality of musical time units, and decoding means for applying a generating index from the generating index storage means to the phrase database means to thereby decode the generating index into a phrase.

This arrangement assures naturalness in a composed melody by the support of the phrase database storing realistic and practical phrases, as knowledge source. Selecting a phrase and concatenating phrases into a melody (involving developing and/or modifying a phrase for a succeeding phrase) can be desirably indicated in the information of generating index. Thus, the present automatic melody composer does not require complicated data processing or algorithmic operations so that it can compose a melody in a real-time environment in prompt response to a request of composition from a user.

BRIEF DESCRIPTION OF THE DRAWINGS

FIG. 6 illustrates a reference rhythm table;

FIG. 7 illustrates a rhythm table;

FIG. 8 illustrates a note type succession table;

FIG. 9 illustrates a pitch class translation table;

FIG. 35 shows a memory configuration of the PC translation table;

DETAILED DESCRIPTION OF THE PREFERRED EMBODIMENTS

The invention will be described in detail with respect to illustrative embodiments.

Figure 1:
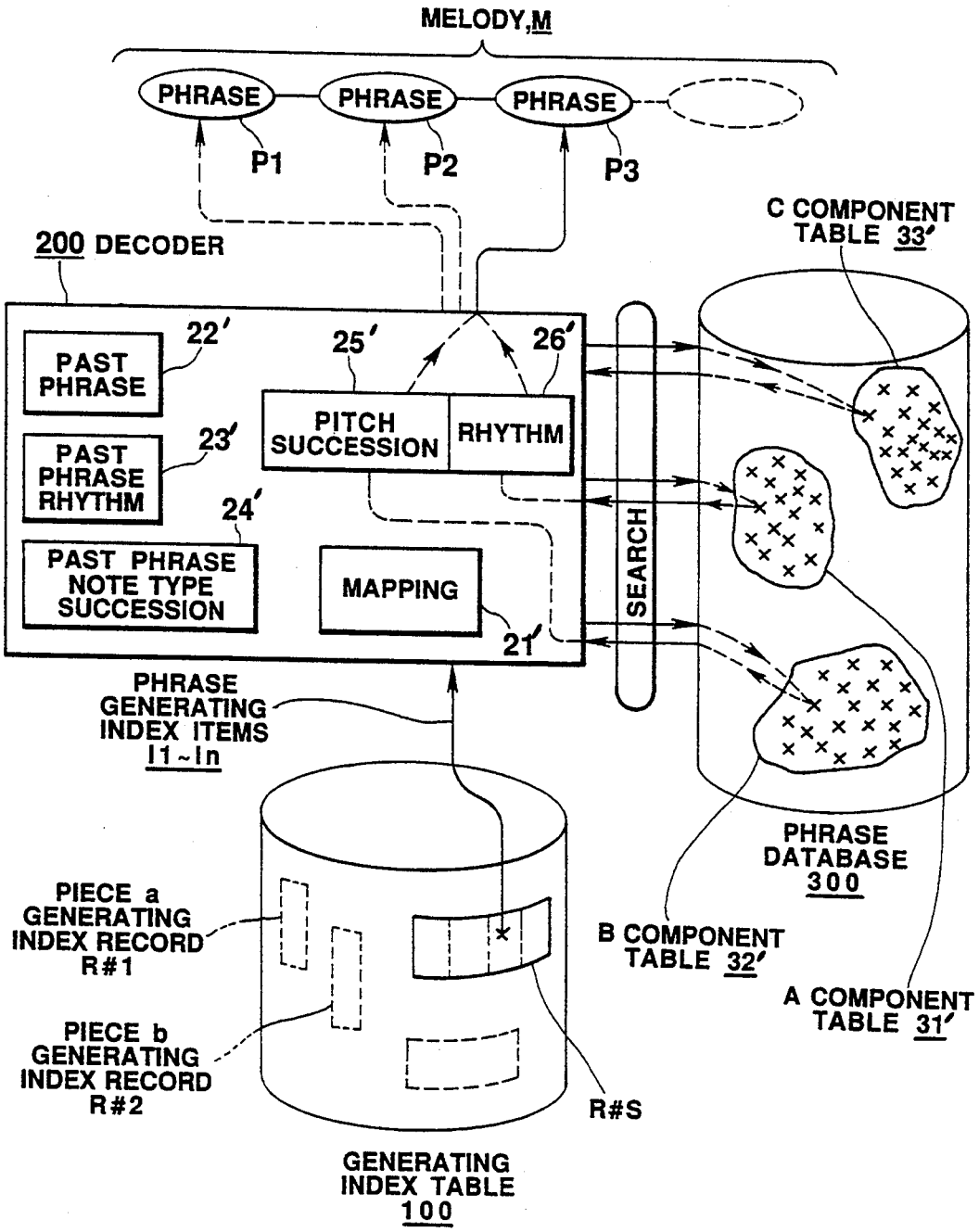
FIG. 1 is a functional block diagram of an automatic melody composer in accordance with principles of the invention.

Principles (FIG. 1)

FIG. 1 shows a functional block diagram of an automatic melody composer in accordance with principles of the invention. A first principle of the present automatic composer is that it composes a melody without relying on a complicated melody composing algorithm, by taking a new approach to utilizing a music database. Using music data as a basis for melody composition will avoid generating unnatural melodies caused by and peculiar to the algorithm. This approach (music data driven melody composing scheme) makes it feasible to provide an automatic composer having a prompt response and a natural melody composing capability. However, storage capacity for the music data is a problem.

For example, suppose that an automatic melody composer has a database of music pieces and composes a melody by retrieving a music piece from the database. Clearly, to provide an extensive space of music composition, the database must contain a very large number of music pieces. Assume, for example, that the average amount of data is 2K bits to represent one music piece melody. For 100,000 music pieces, the total data amounts to 200M bits. Though it may sound large, 100,000 music pieces are very small in number according to the second principle of the invention.

The second principle employs a phrase (melody segment in a predetermined musical time unit) as a unit of composing to make a melody extending over a plurality of such musical time units. Suppose that there are ten candidates each which can be a phrase in a musical time unit and that there are eight musical time units (e.g., eight measures). Then, according to the second principle, all possible combinations of phrases in an eight-measure melody are as many as 10,000,000. Thus, the phrase-by-phrase composing feature provides a huge space of music composition. Combining the first and second principles leads to the phrase database 300 in FIG. 1.

A primary concern of the phrase-by-phrase generating approach is the balance between unity and variety in a phrase succession forming a melody. A mere succession of notes cannot be said to be a musical melody. It is formed by a coherent succession of notes which is accepted as belonging together such that the notes are organically or musically related with one another. Similar relationship exists between melody segments or phrases. They bear musical relationship with each other according to musical progression, style etc. Thus, a first phrase should be followed by a second phrase which matches the first phrase. Therefore, it is desirable for an automatic composer to have musical knowledge which realizes unity in a phrase succession on one hand, and modifies or develops phrases on the other hand.

Such musical knowledge is primarily embedded in the generating index database 100 in FIG. 1.

The Generating index database 100 is a collection of melody Generating index records by which various music pieces may be constructed. In FIG. 1, R#1 indicates a music piece a generating index record, R#2 indicates a piece b generating index record, and so on. Each music generating index record R may comprise a string of phrase generating indexes covering a plurality of musical time units in which each phrase generating index (phrase term) relates to a phrase in one of the musical time units. A set of generating index items Il to In set forth in each phrase term may preferably be undeterministic such that they have several index candidates in view of music possibilities. Suppose, for example, that the average candidate number of a phrase term is three and that the average phrase number of a music generating record R is eight. Then, each music generating record generates, on average, index combinations as many as the eighth power of three for a corresponding number of music pieces. Thus, each record R effectively produces many music pieces (though they have a common feature to some degree). This provides information compression of generating indexes with respect to the music piece number.

Phrase generating index items Il to In contain information used to search the phrase database 300. The phrase generating index items may further contain a command for making similar phrases in different musical time units.

The generating index database 100 may take the form of a collection of phrase term networks for various melody compositions. Each phrase term network represents a music piece melody generating record in which phrase terms are properly linked.

The phrase database 300 may be a mere collection of phrases per se. Whereas such a phrase database makes it easy to configure the system, it limits the space of composable melodies. It would require a large amount of data to provide an extensive space of phrases, though the data amount may be much smaller than that required by a database of music piece melodies per se.

To provide an extensive space of melody compositions, a preferred embodiment of the invention decomposes a phrase into several musical components (e.g., rhythm, rhythm style, note type succession, pitch succession). Thus, several phrase component tables reside in the phrase database 300, as illustrated in FIG. 1 by A component table 31, B component table 32 and C component table 33. Each component table is a collection of corresponding components. For example, the component table 31 is a collection of A components. Each table may essentially be implemented by a look-up table memory.

To make best use of such phrase database 300, it is desirable to provide table-to-table associating means which indicates which element or group of elements in a component table matches which element or group of elements in another component table. This is accomplished by affixing, to each table element or element group in a table, associating information which points out a table element or element group in another table. In the alternative or combination, the phrase generating index record may contain an item which indicates how phrase components are associated with each other.

Such associating is a mapping of one component table to another. Suppose, for example, that table 31 is a phrase rhythm table and that table 33 is a phrase note type succession table. Then, mapping information which maps a rhythm or rhythm group in the phrase rhythm table 31 into a note succession or note succession group in the phrase note succession table 33 may be contained either in the phrase rhythm table 31 or in the phrase generating record. The associating means serves to provide an extensive space of phrases while avoiding meaningless combination of phrase components.

In FIG. 1, the decoder 200 picks up a music generating record (here R#S), and applies each phrase generating index Il to In contained therein for an individual musical time unit to the phrase database to thereby decode the phrase generating index into a phrase.

For example, the record R#S may comprise a succession of phrase generating indexes covering four phrases extending over four musical time units. Then, the decoder 200 generates or composes a first phrase P1 in the first musical time unit from the first phrase Generating index, composes a second phrase P2 in the second musical time unit from the second phrase generating index and so on until it composes a fourth phrase in the fourth musical time unit from the fourth phrase generating index. This results in a melody M made of four phrases.

The decoder 200 may essentially be configured by mapping modules (one of which is represented by 21) each of which gets mapped data by looking up look-up tables in the phrase database 300. This configuration has the advantage that it speeds up the operation of the decoder 200, and therefore, the response of the automatic melody composer.

For example, the decoder 200 uses a first item Il of the first phrase Generating index to look up a phrase component table in the phrase database 300 to thereby retrieve mapped data (decoded result) of the first item Il of the first phrase generating index. Further the decoder 200 may cause a mapping module 21' to combine mapped data retrieved from the phrase database with a proper item in the phrase generating index and use it to look up another component table in the phrase database to retrieve further mapped data with respect to the phrase component of the looked up table. Of such mapped data, rhythm and pitch succession, which form a surface of music, are designated by reference numerals 26' and 25', respectively within the block of the decoder 200. Also shown within the decoder 200 are a past phrase 22', a past phrase rhythm 23' and a past phrase note type succession 24', each generated by the decoder 200. For a succeeding phrase, a mapping module in the decoder 200 may utilize the past phrase information 22'-24'. For example, using the past phrase note type succession 24' as a first search argument and using a pitch index item in a phrase generating index, a mapping module looks up a note type succession table in the phrase database 300 to retrieve mapped data indicative of a note type succession of a succeeding phrase. In another example, using the past phrase rhythm 23 as a first argument, and using a rhythm change index item in a phrase generating index, another mapping module in the decoder 200 looks up a rhythm table in the phrase database 300 to retrieve mapped data indicative of a succeeding phrase rhythm. These mapping modules advantageously achieve a desired degree similarity or difference between phrases, in accordance with the generating index record R#S and data in the phrase database. In the simplest example, a phrase repeat command may be included in a phrase generating index. Then, the decoder 200 generates a current phrase P3 which is identical with a past phrase 22' for structural repeating of phrases Such structural repeating is particularly advantageous when a theme phrase is repeated. A means for setting a theme may be provided (not shown in FIG. 1) to allow the decoder 200 to select a melody generating index record R#S in the generating index table 100 according to the theme.

The phrase pitch succession 25' and phrase rhythm 26', obtained by mapping modules in the decoder 200 represent a melody segment in a musical time unit, i.e., phrase, as indicated by an arrow connecting boxes 25' and 26' to the current phrase P3 in FIG. 1.

Figure 2:
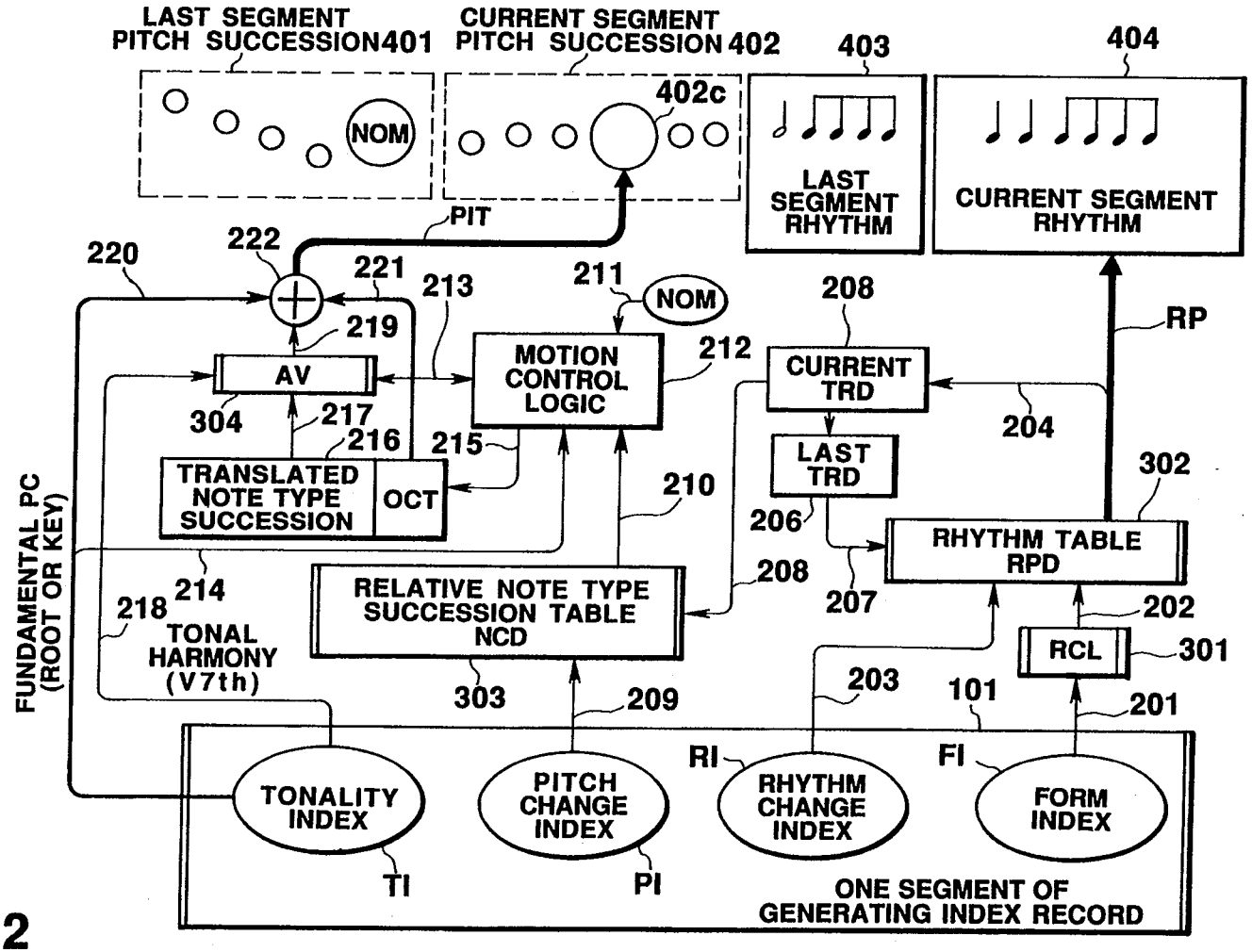
FIG. 2 is a functional block diagram of an automatic melody composer in accordance with an embodiment of the invention.

Embodiment of Melody Composer (FIG. 2)

FIG. 2 is a functional diagram of an automatic melody composer embodying the principles of the invention described in conjunction with FIG. 1. In FIG. 2, those components designated by numbers between 200 and 299 constitute, as a whole, an embodiment of the decoder 200. Those components designated by numbers between 300 and 399 define an embodiment of the phrase database 300. Those components designated by numbers between 400 and 499 indicate surface information on a composed melody. The component 101 represents a phrase generating index set for a musical time unit. The phrase generating index set 101 is a segment of a melody generating index record R#S in the generating index database 100.

Thus, in FIG. 2, the phrase database is configured by RCL table 301, RPD rhythm table 302, NCD relative note type succession table 303 and AV pitch class translation table 304. The phrase generating index set 101 contains items of tonality index TI, pitch change index PI, rhythm change index RI and form index FI. Tonality index TI represents tonality in the musical time unit of the phrase generating index set 101. Pitch change index PI is a pitch control factor in the musical time unit of the phrase generating index set 101. Rhythm change index RI is a phrase rhythm control factor in the musical time unit of the phrase generating index set 101. Form index FI indicates phrase form of the phrase generating index set 101, used here to designate a rhythm group.

In the composed melody surface information, 401 indicates a last phrase pitch succession in the last (previous) musical time unit, 402 indicates a current phrase pitch succession in the current musical time unit, 403 indicates a last phrase rhythm (note durational succession) in the last musical time unit, and 404 indicates a current phrase rhythm in the current musical time unit . Thus, the current phrase or melody segment in the current musical time unit is specified by the current phrase pitch succession 402 and the current phrase rhythm 404. Similarly, the last phrase i.e., melody segment in the last musical time unit is specified by the last phrase pitch succession 401 and the last phrase rhythm 403.

In FIG. 2, the decoder uses the current phrase generating index set 101 and the phrase database (301, 302, 303, 304) in the following manner to generate or compose the current phrase (pitch succession 402, rhythm 404). Specifically, the decoder applies form index FI to RCL table 301, as indicated by line 201 to look up mapped data of the form index FI. The mapped data is used to designate a rhythm group to which the current phrase rhythm pertains. To this end, the decoder uses the looked-up data from RCL table 301 as a first argument or search key for RPD rhythm table 302, as indicated by line 202. The decoder uses the rhythm change index RI in the current phrase generating index set 101 as a second search argument for RPD rhythm table, as indicated by line 203. Further, the decoder uses the last TRD 206 identifying the last phrase rhythm as a third search argument for RPD rhythm table 302, as indicated by line 207. In response to the combination of these arguments (i.e., rhythm change index RI, RCL table output, last phrase rhythm information 206), the RPD rhythm table 302 outputs a rhythm pattern RP defining the current phrase rhythm 404 together with the identifier or name of the current phrase rhythm.

Then, the decoder 200 stores the current phrase rhythm identifier into current TRD register 208, as indicated by line 204. The information stored in the current TRD 208 is transferred to the old TRD register 206 when the next phrase composing starts.

The decoder 200 utilizes the current phrase rhythm as a parameter for determining a group of note type successions, any of which the current phrase may have. To this end, the decoder 200 uses the current phrase rhythm identifier stored in the current TRD register 208 as a first search argument of NCD relative note type succession table 303, as indicated by line 208. Further, the decoder 200 uses the pitch change index PI in the current phrase generating index set 101 as a second search argument of NCD relative note-type succession table 303, as indicated by line 208. In response to the combination of the first and second arguments, NCD relative note-type succession table 303 outputs data of an appropriate relative note type succession. The term "relative note type succession" refers to a note type succession determined relatively in relation to a reference pitch. The term "note type succession" refers to musical information which can be translated into a specific pitch succession (as melody surface) when tonality or tonal harmony is specified. Simply, the note type succession is an abstract pitch succession. In other words, note type succession is the information which is derived from a succession of melody surface pitches (e.g., C4, B4) when it is analyzed by its musical background of tonality.

An important function of the decoder 200 is to compose a melody surface pitch succession, here, the current phrase pitch succession 402. The decoder 200 processes the relative note type succession from NCD relative note type table 303 in the following manner to form phrase surface pitch succession 402.

Specifically, the decoder 200 causes motion control logic 212 to receive the relative note type succession output from NCD relative note type succession table 303, as indicated by line 210. The motion control logic 212 translates the relative note type succession according to a reference pitch NOM to adjust pitch range of the current phrase to that of the last phrase. To this end, the motion control logic 212 receives the information on the reference pitch NOM, as indicated by line 211. In the example of FIG. 2, the reference pitch NOM is defined by the end pitch of the last phrase. Further, the motion control logic 212 receives a fundamental pitch class (of keynote or chord root) contained in the tonality index TI in the current phrase generating index set 101, as indicated by line 214. The motion control logic 212 uses the reference pitch NOM to determine a note type having a particular pitch relationship with the reference pitch NOM (e.g., the note type directly above the reference pitch).

To this end, the motion control logic 212 translates each note type into a pitch class. This may be accomplished by retrieving PC data of each note type from pitch class translation table (AV) 304, as indicated by line 213 and by performing modulo twelve addition of each retrieved PC and the fundamental pitch class (of root or keynote) on the line 214. Then, the motion control logic 212 compares each translated pitch class of note type with the pitch class of the reference pitch NOM to find a note type bearing the particular pitch relation with the reference pitch NOM. The term "pitch class" refers to a pitch name without reference to the octave such as C and D. For example, pitches of C in first octave and C in fifth octave are said as belonging to the same pitch class of C.

Then, the motion control logic 212 uses the found note type having the particular pitch relation with the reference pitch NOM to translate the relative note type succession retrieved from the relative note type succession table 303 to thereby form a translated note type succession 216 by way of line 215. Further, the motion control logic 212 sets the octave by way of line 215. Then the decoder 200 converts the translated note type succession into the current phrase pitch succession 402 through the pitch class translation table 304. Specifically, the decoder 200 uses each element (note type) of the translated note type succession 216 as a first argument of the pitch class translation table 304, as indicated by line 217. The decoder 200 also applies tonal harmony (e.g., V7th) from the tonality index TI as a second search argument of the pitch class translation table 304. The combination of these arguments specifies a location in the pitch class translation table which stores data of a pitch interval of the note type on the line 217 measured from the fundamental pitch class according the tonal harmony on the line 218. Thus, the decoder 200 performs modulo 12 (octave) addition of the pitch interval output from the pitch class translation table 304 and the fundamental pitch class from the tonality index PI, as indicated by lines 219 and 220 and the summer 222, to thereby convert the note type into a pitch class. The decoder further adds the proper octave by line 221 to the converted pitch class into thereby form a specific pitch PIT. The pitch data PIT specifies a pitch element 402C of interest in the current phrase pitch succession 402. Each element of the translated note type succession is processed in this manner to thereby Generate the current phrase pitch succession 402.

The motion control logic 212 of FIG. 2 is provided primarily for the purpose of data compression. If an increase in the storage capacity is not a problem, the motion control logic 212 may be replaced by a pitch succession table. Such pitch succession table may receive the combination of four search arguments in which the first argument is given by the current TRD 205, second argument is given by the pitch change index PI, third argument is given by the NOM information (e.g., pitch interval of NOM pitch class from the fundamental pitch class in the current phrase tonality index) and fourth argument is given by the tonal harmony in the current phrase tonality index. In response to the combination, the pitch succession table outputs a pitch succession in which each element indicates a pitch interval from the fundamental pitch class. However, such pitch succession table would require much larger combinations of argument than that required by the relative note type succession table 303. For example, with 20 instances of the tonal harmony index and 12 pitch classes for the fundamental pitch, the argument combinations are increased to 240 times. This means that the pitch succession table (look-up table memory) requires a huge address space. The storage capacity of the pitch succession table is also increased to 240 times assuming that a one pitch succession is provided for each argument combination.

The arrangement of FIG. 2 embodies the automatic melody composer in accordance with the principles of the invention discussed in conjunction with FIG. 1 while considering the amount of storage (particularly, the internal storage) available by a typical microcomputer of today. Thus, the arrangement of FIG. 2 is the best mode of the invention through, of course, the invention is not restricted thereto.

For example, RCL table 301 may be omitted so that the form index FI is directly applied to the rhythm table 302, as a direct argument. TRD 208 is not necessarily the unique identifier of rhythm. It may be a parameter indicative of the current phrase rhythm feature. This means that each rhythm data record RP in the rhythm table 302 contains such a parameter. The use of rhythm feature information instead of unique rhythm identifier reduces the instance number of current TRD 205. The storage capacity of the relative note type succession table 303 can also be reduced if it is addressed by the rhythm feature information.

In the arrangement of FIG. 2, the last phrase rhythm identifier is applied, as an argument, to the rhythm table 302. However, rhythm identifier of preceding phrase other than the last one (e.g., two or three phrases before the current) may be substituted.

The use of the last phrases rhythm identifier to look up the rhythm table for the current phrase rhythm, as done in the arrangement of FIG. 2, makes the current phrase rhythm closely related with the last phrase rhythm. However, as experienced in music, several small phrases are often put together into a one larger phrase. As often observed in actual melodies, when halving each phrase in a phase succession, the feature of the first half of the phrase recurs not in the second half thereof but recurs in the first half of the next phrase whereas the feature of the second half of the phrase does not recur or reflect in the first half of the next phrase but does in the second half of the next phrase. To simulate this, old TRD register 206 may store the rhythm identified or rhythm feature information of two phrases before the current to thereby use it to look up the current phrase rhythm table 302. The information designating which past phrase rhythm is reflected in the current phrase may be contained in the current phrase generating index set 101.

In FIG. 2, the current TRD 205 provides association between the rhythm table 302 and the relative note type succession table 303. In the alternative, each note type succession record in the relative note type succession table 303 may contain information on the feature of the note type succession, and such feature information is applied, as a search argument, to the rhythm table 303. It may also be arranged such that the information on the feature of the last or other predetermined past relative note type succession may be applied, as a third argument, to the relative note type succession table 303. This arrangement provides close correlation between the current and past phrase note type successions, and thus provides close correlation between the current and past phrase pitch successions. Other various modifications can also be made according to the principles of the invention discussed in connection with FIG. 1.

Figure 3:
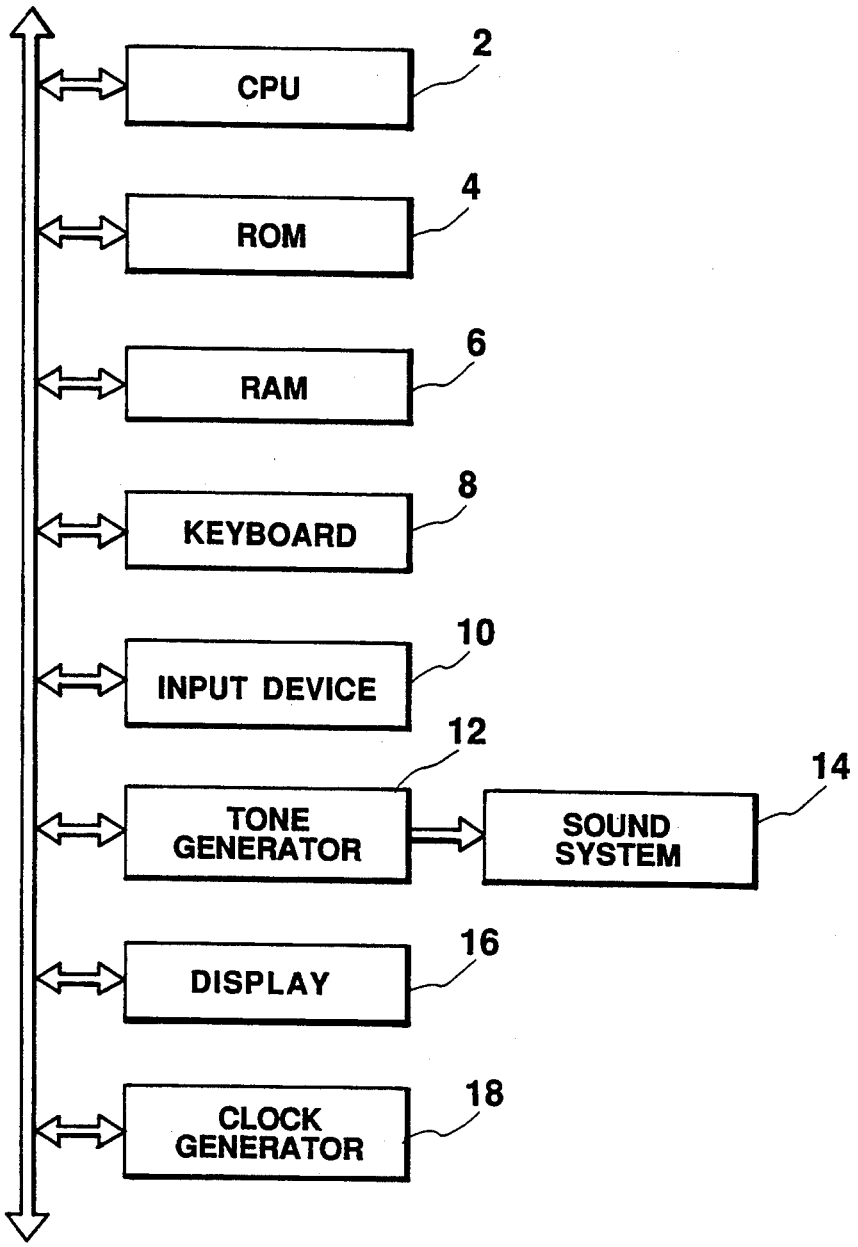
FIG. 3 is a block diagram of a representative hardware organization in which a first specific embodiment of the automatic melody composer may be implemented.

Hardware Organization (FIG. 3)

FIG. 3 shows a representative hardware organization (computer-based organization) in which an automatic melody composer such as the one described in conjunction with FIG. 2 may be implemented. CPU 2 executes programs stored in ROM 4 to control various parts of the system. ROM 4 stores permanent data as well as programs. For the automatic melody composer, the phrase database, generating index database and theme database reside in ROM 4. RAM 6 stores variables and temporary data (e.g., composed melody data), and is used as a working memory of CPU. A keyboard 8 may comprise a conventional musical keyboard in an electronic keyboard instrument, and is used to enter musical performance. An input device 18 may include various switches and volumes used in a conventional electronic keyboard instrument. For the automatic melody composer, a selector in the input device selects a theme. Such selector may take the form of a rhythm or accompaniment style selector used in an electronic musical instrument with automatic accompaniment feature. In this connection, the theme database or table residing in ROM 4 contains a reasonable number of themes for each rhythm or accompaniment style. A tone generator 12 electronically generates a tone signal under the control of CPU 2. A sound system 14 receives the tone signal from the tone generator 12 and reproduces a sound. A display device 16 may comprise LCD display and LED elements to indicate a system state and message for a user. A clock generator 18 generates a clock pulse each time when a predetermined amount of time has elapsed. The clock pulse requests a time-interrupt to CPU 2 to allow the system to perform a periodic time process (e.g., for automatic performance of a composed melody). To this end, clock pulses may be counted in the time-interrupt routine by CPU 2. When the count has reached a number corresponding to a music resolution time unit, a main program checks a note-on or off task to thereby process the automatic music performance.

Details (FIGS. 4–19)

The first specific embodiment of the automatic melody composer will be described in detail by reference to FIGS. 4 to 19.

Figure 4:
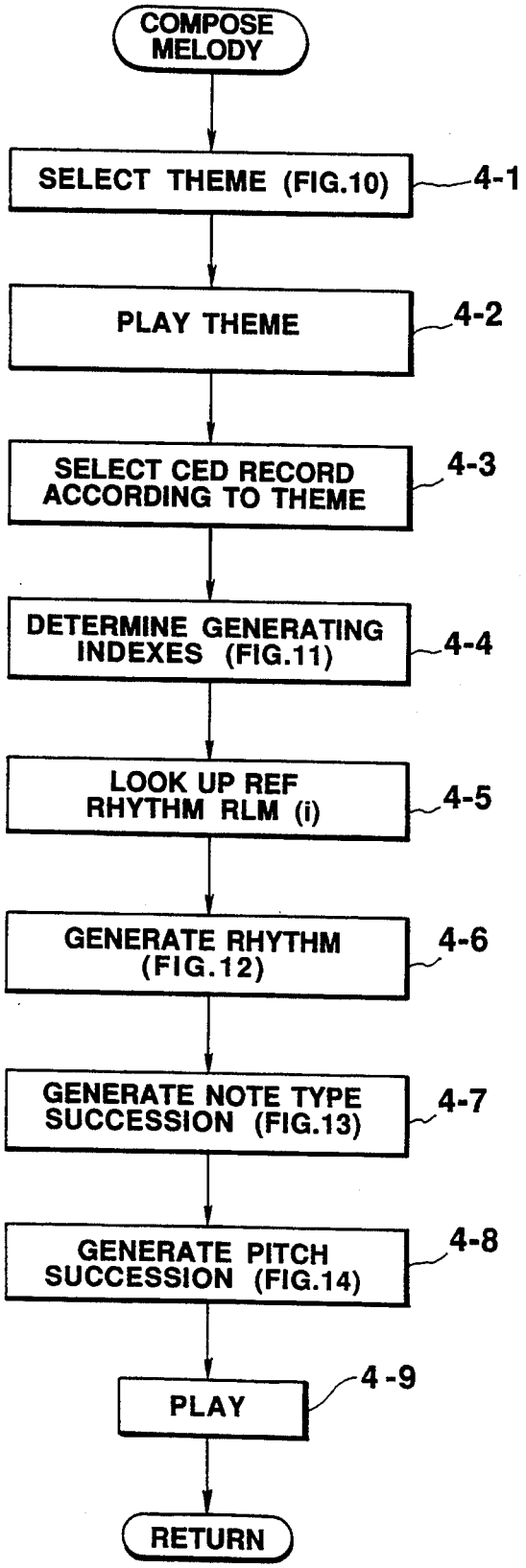
FIG. 4 is a general flow chart showing the melody composition process of the first embodiment.

FIG. 4 is a general flow of composed melody, showing the overall operation of the automatic melody composer.

First (4-1), the automatic melody composer selects a theme. Next (4-2), the composer selects a CED record (melody generating index record). The CED record contains a plurality of index candidates for each phrase. In step 4-4, the automatic melody composer determines a generating index for automatic melody by selecting one of the candidates. In step 4-5, the composer applies a form index item in the determined generating index to reference rhythm table to look up a reference rhythm pattern. In step 4-6, the composer generates a melody rhythm. In step 4-7, the composer generates a melody note type succession. In step 4-8, the composer generates a melody pitch succession. At this point, a melody has been composed: the rhythm and pitch succession generated in steps 4-6 and 4-8, respectively, forms the composed melody. Finally (4-9), the composer automatically plays the composed melody. The overall operation of the automatic melody composer has been summarized. In the following, individual steps and look-up tables involved therein are detailed. Step 4-1 is executed in response to a theme select command from a user. The theme select command is generated by operating a music style selector (e.g., rhythm style selector) in the input device 10. A theme database, which resides in ROM 4, contains a plurality of themes for each music style. The step 4-1 selects one of the plurality of themes.

Figure 10:
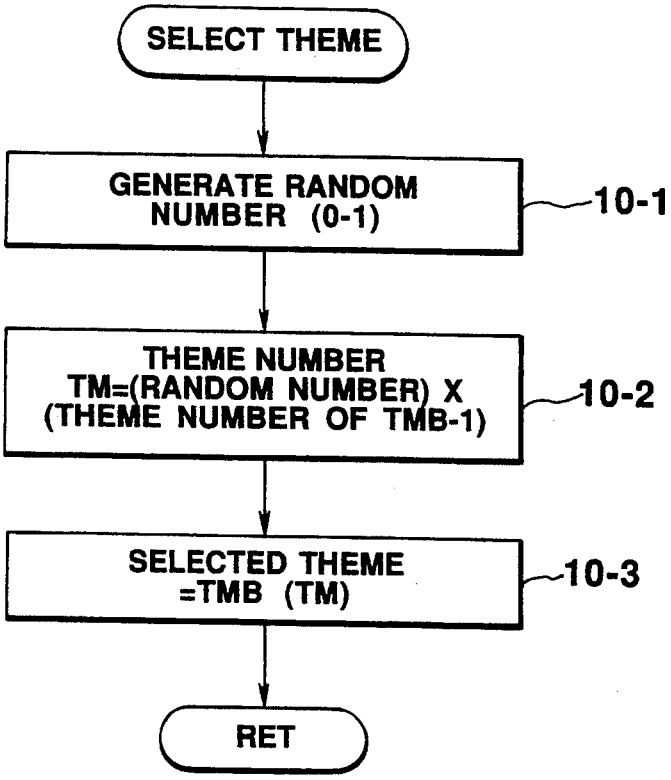
FIG. 10 is a flow chart of a select theme routine.

FIG. 10 details the select theme step or routine 4-1. At 10-1, CPU 2 generates a random number between 0 and 1. At 10-2, CPU 2 generates a selected theme number TM by TM=(random number)×(theme record number N contained in theme bank TMB assigned to the selected music style −1). At 10-3, CPU 2 selects one theme record in the theme bank TMB pointed to by the theme number TM, as indicated by selected theme=TMB(TM). The selected theme record TMB(TM) contains theme information. Thus, in step 4-2, CPU 2 automatically plays the theme recorded in TMB (TM). Each time when a theme melody note-on timing has come, CPU 2 sends a note-on command to the tone generator 12. Each time when a theme melody note-off timing has come, CPU 2 sends a note-off command to the tone generator 12. Thus, the tone generator 12 generates a tone signal of each theme note for automatic theme performance. Then CPU 2 selects a CED record in step 4-3.

The melody generating index database or table CED resides in ROM 4 of FIG. 3. The database CED contains a plurality (preferably, large number) of CED records.

Figure 5:
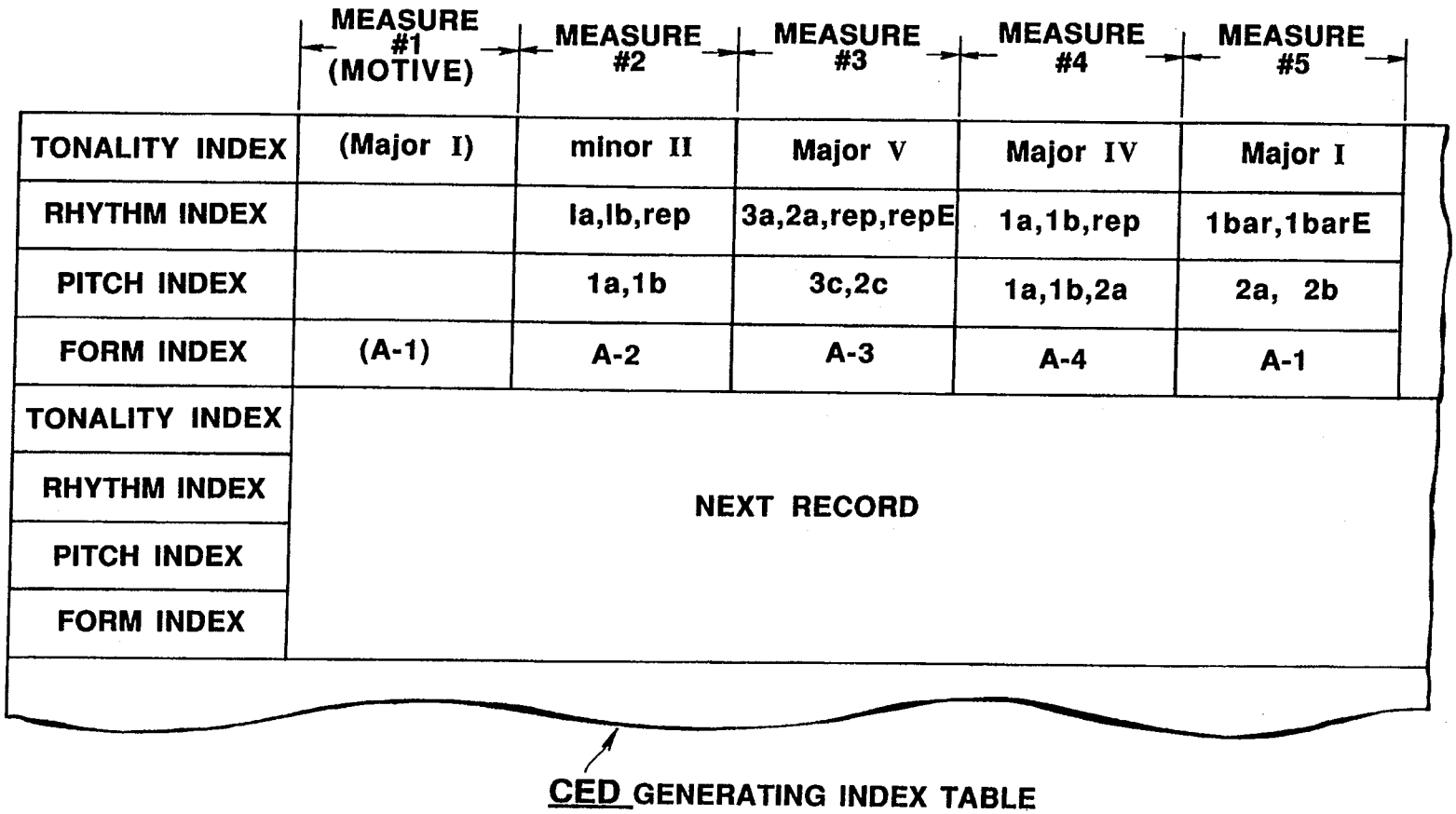
FIG. 5 illustrates a generating index table.

FIG. 5 illustrates the generating index table CED. Each record in the table CED contains a phrase generating index string spanning over a plurality of musical time units (here, measures). Each phrase generating index contains items of tonality index, rhythm index, pitch index and form index. Tonality index and rhythm index each relate to a music progression or structure. The rhythm index primarily relates to a phrase rhythm. The pitch index relates to a phrase pitch. Tonality index in a musical time unit serves to specify a pitch class set (PCS) available in the musical time unit. Each Generating index record directs a melody to be composed and follow the theme or motive. Thus, the theme occupies the first measure. The melody of the following measures is composed based on a selected CED record. For convenience, the first or motive measure term or column is shown in a CED record in FIG. 5. In fact, the motive or theme term information is contained not in a CED record but in a theme record in the theme bank.

In FIG. 5, each of rhythm index and pitch index in an individual measure term contains more than one element or instance. Each element is a candidate for the index item. For example, in the second measure, the rhythm index has candidates of 1*a*, 1*b* and rep. The pitch index in the second measure has candidates of 1*a* and 1*b*. Some rhythm index instances are repeat commands directing structural repeat of music. For example, the rhythm index instance rep is a command for directing repeat of the last measure rhythm at the current measure time unit. The index instance repE is a command for directing repeat of last measure rhythm and note-type succession at the current measure. The index instance code 1BAR is a command for directing repeat of the theme (motive) measure rhythm at the current measure. The reason for providing these commands in the item of rhythm index is to minimize the item number of CED record i.e., to save the data amount of CED record. Thus, these commands may be contained in an item other than the rhythm index (e.g., form index item). An important consideration is to configure the index information such that it can direct various phrases while saving the record data amount.

The generating index table CED may contain a plurality of records per music style or theme. In this regard, the select CED record step 4-3 (FIG. 4) selects at random one of the CED records assigned to the music style or theme. The selected CED record is used as a basis for melody composition. It is noted, however, that each item of rhythm index and pitch index contains more than one candidate. Thus, the determine generating step 4-4 involves selecting one of the candidates to specify a generating index for each musical time unit.

Figure 11:
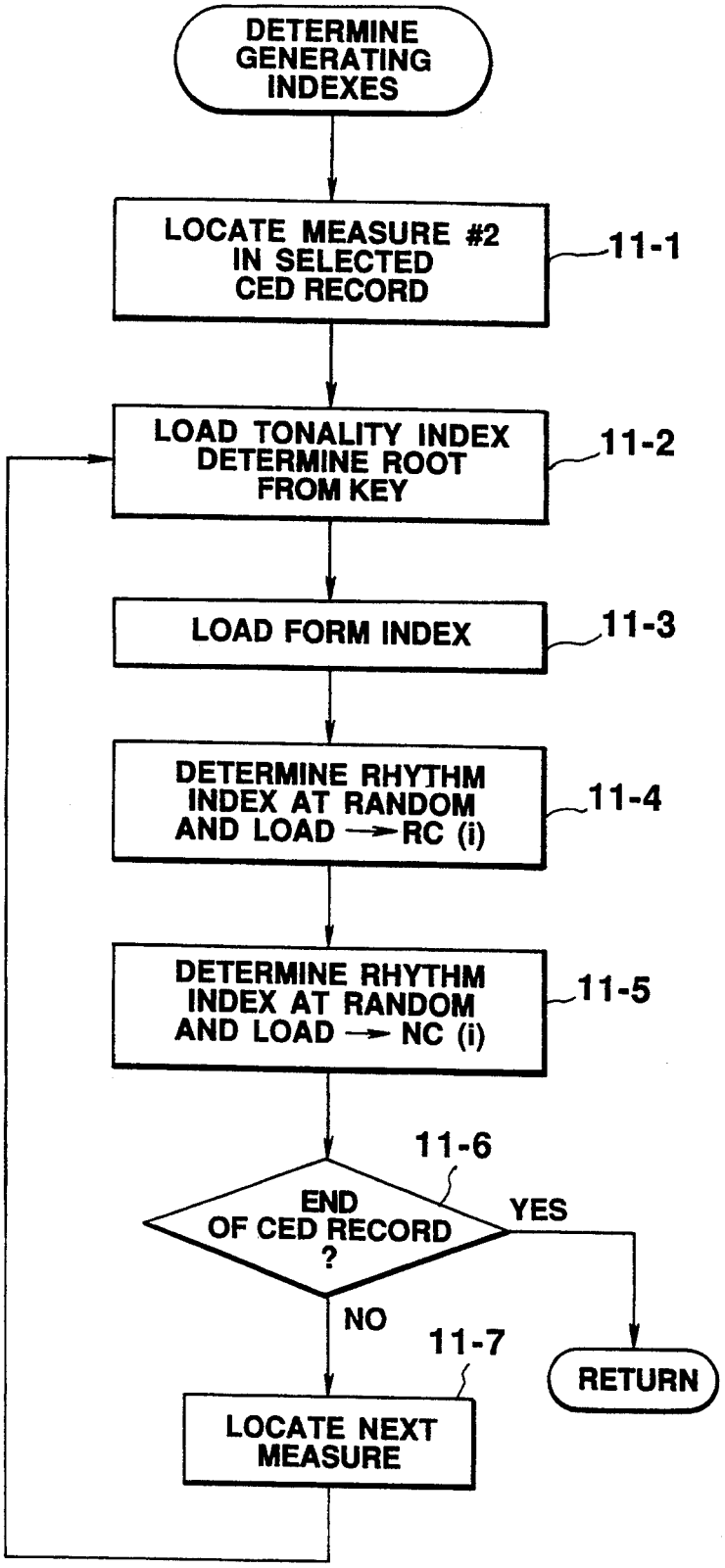
FIG. 11 is a flow chart of a determine generating indexes routine.

FIG. 11 is a flow chart of the determine generating index step 4-4. First (11-1), CPU 2 locates the second measure term in the selected CED record. In the loop of 11-2 to 11-7, at 11-2, CPU 2 loads tonality index of a measure of interest and determines a chord root from the keynote. The keynote has been initialized in the system initialization, and may be updated by a transponse key in the input device 10 during the system operation. The chord root is determined from the keynote by using degree information (e.g., V in Major V) contained in the tonality index. That is, adding the degree to the keynote yields the chord root. At 11-3, CPU 2 loads the form index of the measure of interest. At 11-4, CPU 2 selects at random one of the candidates contained in the rhythm index item of the measure term, and loads it into RC(i). At 11-5, CPU 2 selects at random one of the candidates recorded in the pitch index item of the measure term, and loads it into NC(i). At 11-6, CPU 2 checks whether the end of the CED record has been reached. If not, CPU 2 locates the next measure (11-7) and repeats the process. In the affirmative, a phrase generating index has been determined with respect to every measure of a melody to be composed.

Next, CPU 2 executes the look up reference rhythm step 4-5 (FIG. 4). The reference rhythm table RCL referenced in step 4-5 resides in ROM 4.

FIG. 6 illustrates the reference rhythm table RCL. The table RCL returns a reference rhythm (symbol) in response to a form index input. Thus, step 4-5 uses a form index item of the generating index determined in step 4-4 with respect to each measure to look up the table RCL to retrieve corresponding reference rhythm data into an array {RLM(i)}.

FIG. 7 illustrates the rhythm table RPD referenced in the generate rhythm step 4-6. The rhythm table RPD returns current measure rhythm information (rhythm pattern and its identifier or name) in response to the combination of three search arguments in which the first argument is specified by the reference rhythm pattern RLM, the second argument is specified by the last measure rhythm pattern RLD and the third argument is specified by the current measure rhythm index RC. Thus, rhythm table RPD stores rhythm data for each three argument combination of the reference rhythm pattern RLM, last measure rhythm RLD and current measure rhythm index RC. It does not necessarily mean, however, that there is one-to-one correspondence between the rhythms and the combinations. Preferably, there is provided one-to-many correspondence between the rhythms and the combinations to save the storage capacity of the rhythm table RPD. The last measure rhythm pattern argument RLD may be represented by either the identifier (unique number) of the last measure rhythm or the feature code of the last measure rhythm. The feature code may be specified by the highest bits of the rhythm identifier. The use of the feature code will further reduce the storage capacity of the rhythm table RPD.

Step 4-6 (FIG. 4) looks up the rhythm table RPD (FIG. 7) to generate or compose a phrase rhythm of each measure.

Figure 12:
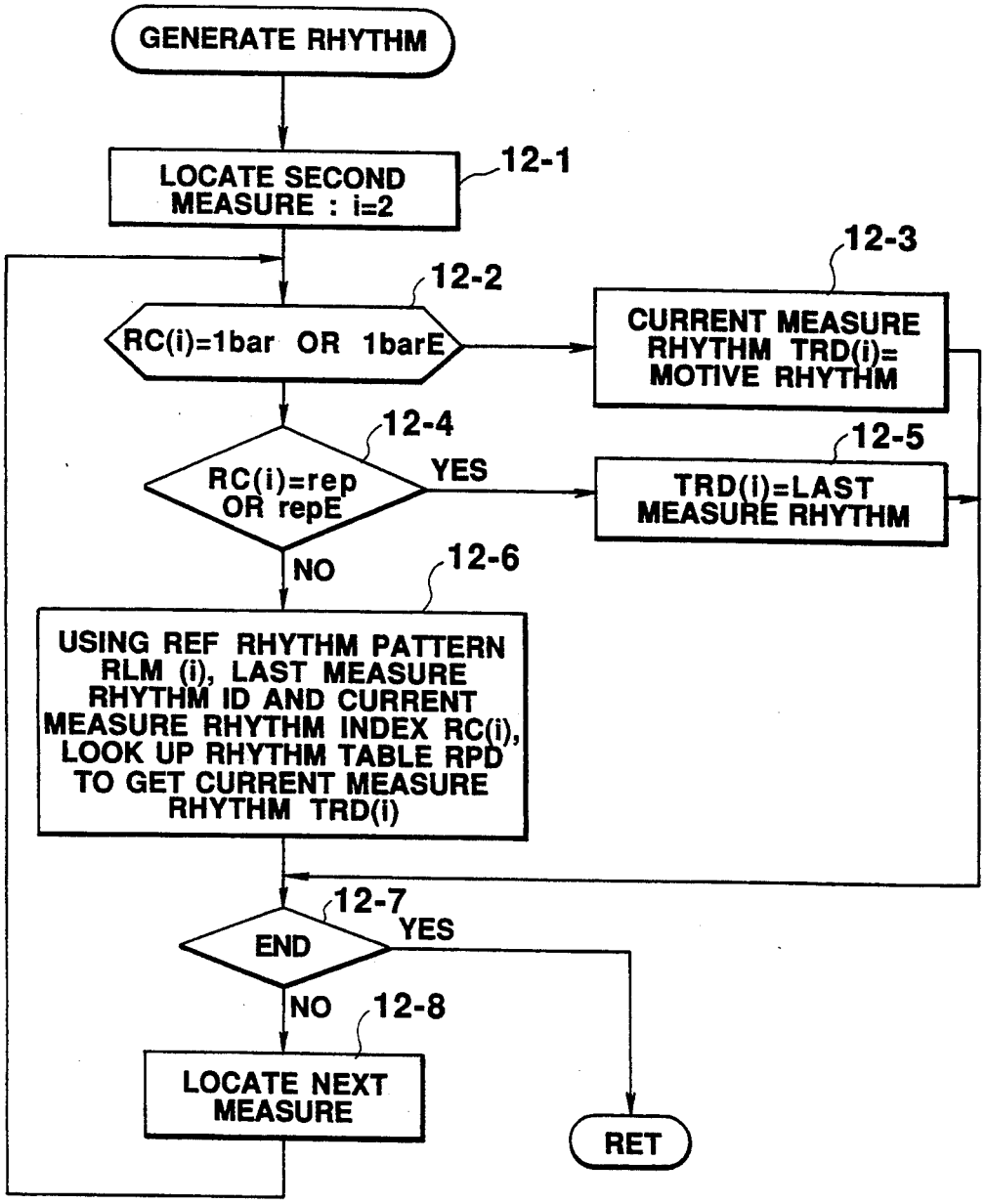
FIG. 12 is a flow chart of a generate rhythm routine.

FIG. 12 is a flow chart of the generate rhythm step 4-6. At 12-1, CPU 2 locates the second measure. In the loop of 12-2 to 12-8, at 12-2, CPU 2 checks whether the rhythm index RC (i) of the current or i-th measure is 1BAR or 1BARE. In the affirmative, CPU 2 determines the current measure rhythm as being identical with the theme or mot ire rhythm (12-3). At 12-4, if the current measure rhythm index RC(i) is either rep or repE, CPU 2 determines the current measure phrase rhythm as being identical with the motive (theme) rhythm (12-5). If the current measure rhythm index RC(i) indicates one of the other instances, CPU 2 uses the reference rhythm pattern RLM(i), last measure rhythm identifier or feature code, and current measure rhythm index RC(i) to look up the rhythm table RPD to thereby retrieve the current measure rhythm data TRD(i), at 12-6. If the end of the CED record has not been reached (12-7), CPU 2 locates the next measure (12-8) and returns to 12-2 to continue the process until all measure rhythms have been determined or generated.

FIG. 8 illustrates the note type succession table NCD referenced in the generate note type succession step 4-7 of FIG. 4. The table NCD resides in ROM 4 of FIG. 3. The note type succession table NCD returns a current measure note type succession in response to the combination of two search arguments in which the first argument is specified by the current measure rhythm identifier or feature code TRD, and the second argument is specified by the current measure pitch index NC. The automatic melody composer takes a note type succession from the note type succession table NCD, as a relative one in relation to a reference pitch NOM. In the illustrated note type succession table NCD, k1, k2, k3 and k4 indicate, respectively, the first, second, third and fourth chord members each counted from the reference pitch NOM. The symbols of st 2, st 4 and st 6 indicate, respectively, the second, fourth and sixth scale note members each measured from the reference pitch NOM. This statement is commensurate with the music convention which says that a chord member is a scale member. In another nomenclature which makes distinction between a chord member and a scale note other than chord members, as done in the translation process of note type succession, st2, st4 and st6 are called the first, second and third scale note, respectively. Each illustrated note type succession contains symbols of + and −. These symbols indicate direction. Specifically, symbol indicates that the note type is higher than the reference pitch while symbol—indicates that the note type is lower than the reference pitch NOM. Thus, +k1 indicates a first chord member directly above the reference pitch NOM whereas −k4 indicates a chord member directly below the reference pitch NOM. This is because the chord members are built up in the vertical (pitch ascending) direction, in the cyclic order of k1, k2, k3, k4, k1, k2, k3, k4, and so on. Similarly, the scale notes are cyclically built up in the order of st2, st4, st6, st2, st4, st6, and so on in the pitch ascending direction. Thus, st2 indicates a scale note directly above the reference pitch whereas st6 indicates a scale note immediately below NOM. The generate note type succession step 4-7 looks up the note type succession table NCD of FIG. 8 to generate a note type succession for each measure.

Figure 13:
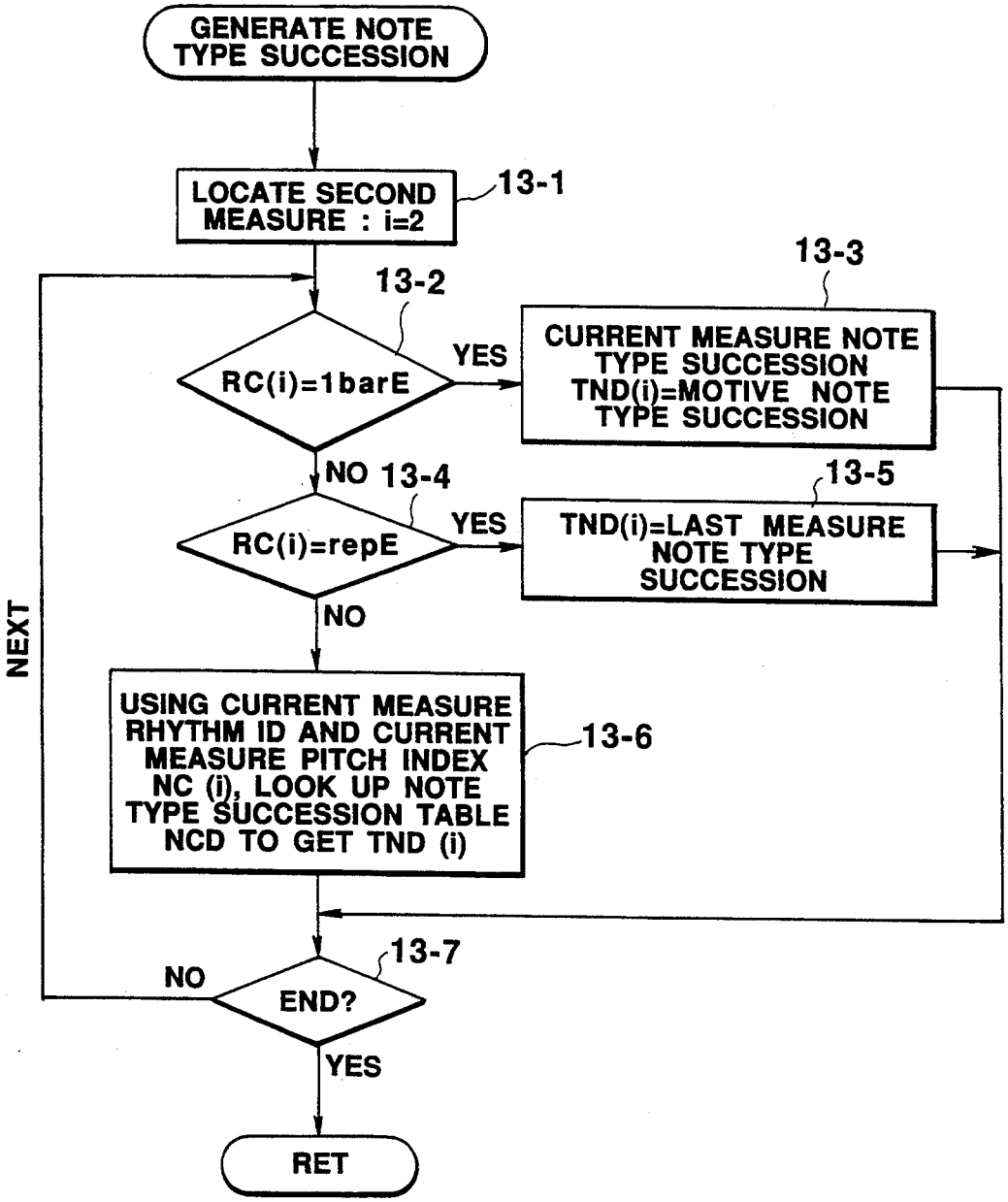
FIG. 13 is a flow chart of a generate note type succession routine.

FIG. 13 is a flow chart of the generate note type succession step 4-7. First (13-1), CPU 2 locates the second measure as the current measure (i=2). In the loop of 13-2 to 13-6, at 13-2, if the current measure rhythm index RC(i) is 1BARE, CPU 2 determines the current measure note type succession TND(i) as being identical with the motive (theme) note type succession. At 13-4, if Re(i) is equal to repE, CPU 2 determines the current measure note type succession TND(i) as being identical with the last measure note type succession (13-5). If the current measure rhythm index Re(i) is neither 1BARE nor repE, CPU 2 uses the current measure rhythm identifier Re(i) and current measure pitch index NC(i) to look up the note type succession table NCD to thereby retrieve the current measure note type succession TND(i). At step 13-7, if there remains a measure to be processed, the next measure is located and the process repeats until all measure note type successions have been determined or generated.

Figure 14:
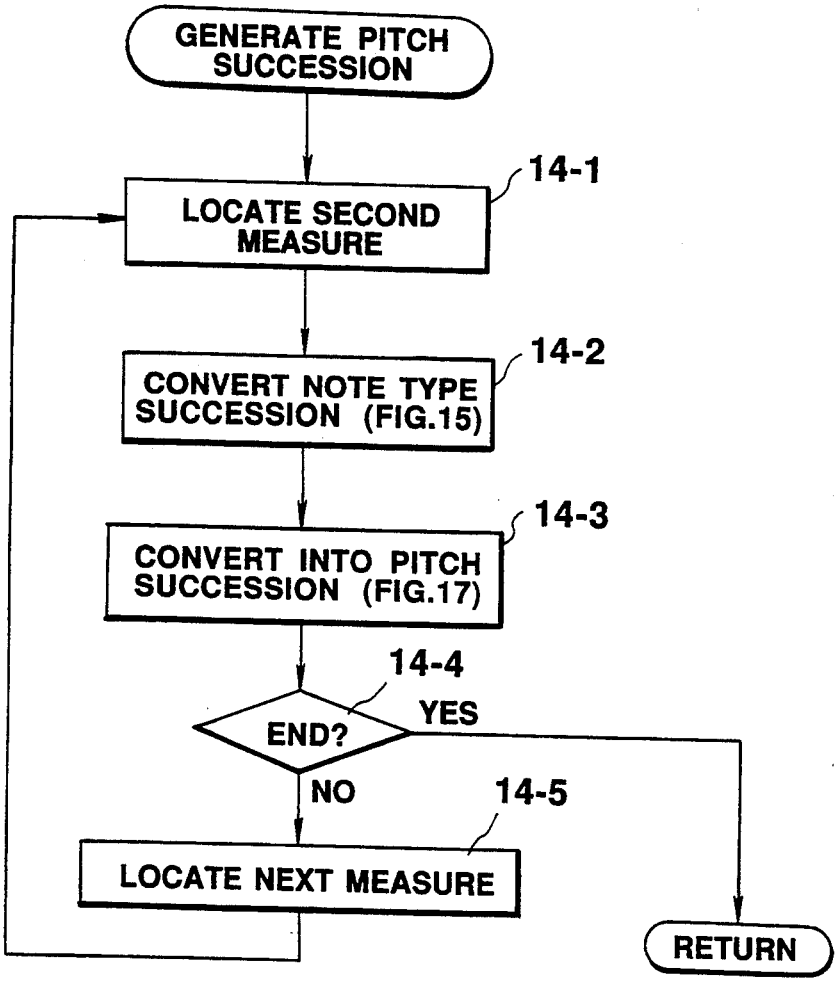
FIG. 14 is a flow chart of a generate pitch succession routine.
Figure 15:
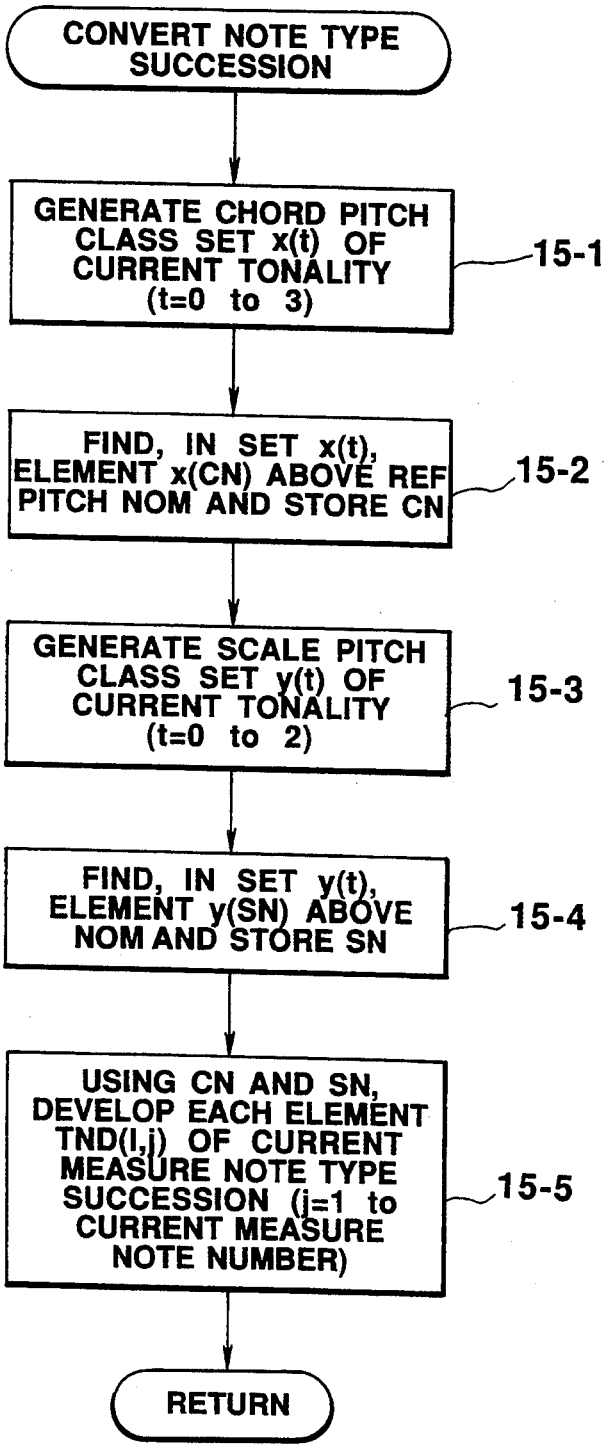
FIG. 15 is a flow chart of a convert note type succession routine.
Figure 17:
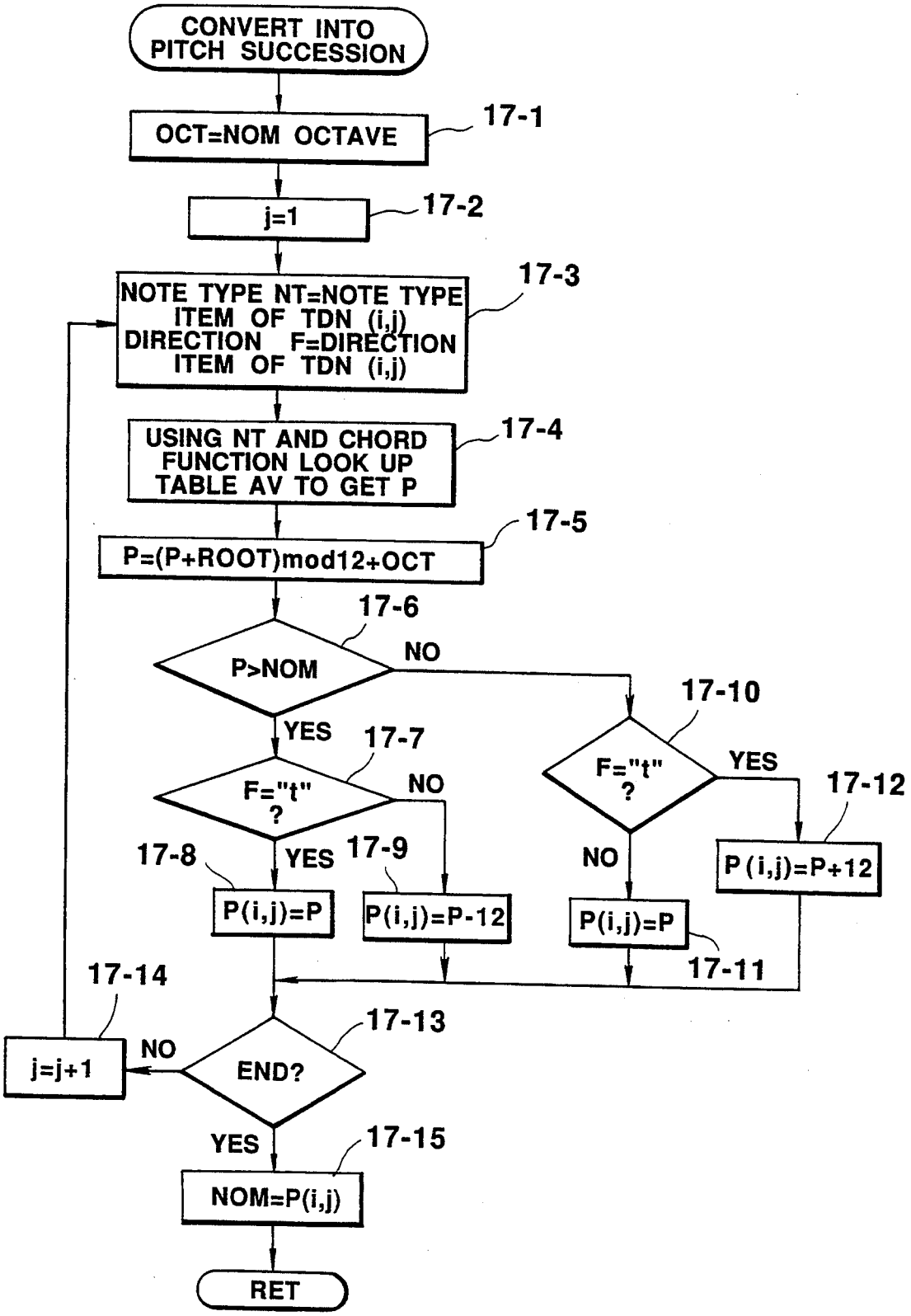
FIG. 17 is a flow chart of a convert into pitch succession routine.

FIG. 14 is a flow chart of the generate pitch succession step 4-8. First (14-1), the second measure is located as the current measure. In the loop of 14-2 to 14-5, at 14-2, CPU 2 converts or translates the note type succession (FIG. 15). At 14-3, CPU 2 converts the translated note type succession into a pitch succession (FIG. 17). At 14-4, if the end of the CED record has not been reached, the next measure is located (14-5), returning to 14-2.

FIG. 15 is a detailed flow chart of the convert note type succession step or routine 14-2. The object of this routine is to convert a relative note type succession defined in relation to the reference pitch NOM into another form of note type succession in which the first chord member is defined by chord root. This conversion aims to adjust or control motion or voice leading from one measure pitch succession to the next measure pitch succession. As Will be described, the pitch class translation table AV has the data format according to which a chord root defines the first chord member. Such format requires the conversion of note type succession which is thus a preprocess for enabling the pitch translation table AV to perform an intended pitch translation.

At first (15-1), CPU 2 generates a chord pitch class set {X(t)}, here t=0 to 3, of the tonal harmony set forth in the current measure tonality index. At 15-2, CPU 2 finds an element X (CN) of the chord pitch class set directly above the reference pitch NOM and stores CN. In the present embodiment, the reference pitch NOM is specified by the ending pitch of the last measure. At 15-3, CPU 2 generates a scale pitch class set {Y(t)}, here t=0 to 2, from the current measure tonality. At 15-4, CPU 2 finds an element Y(SN) of the scale pitch class set directly above the last measure ending pitch NOM. Finally (15-5), CPU 2 develops (converts) each element TND (i;j) of the current measure note type succession according to CN and SN.

Figure 16:
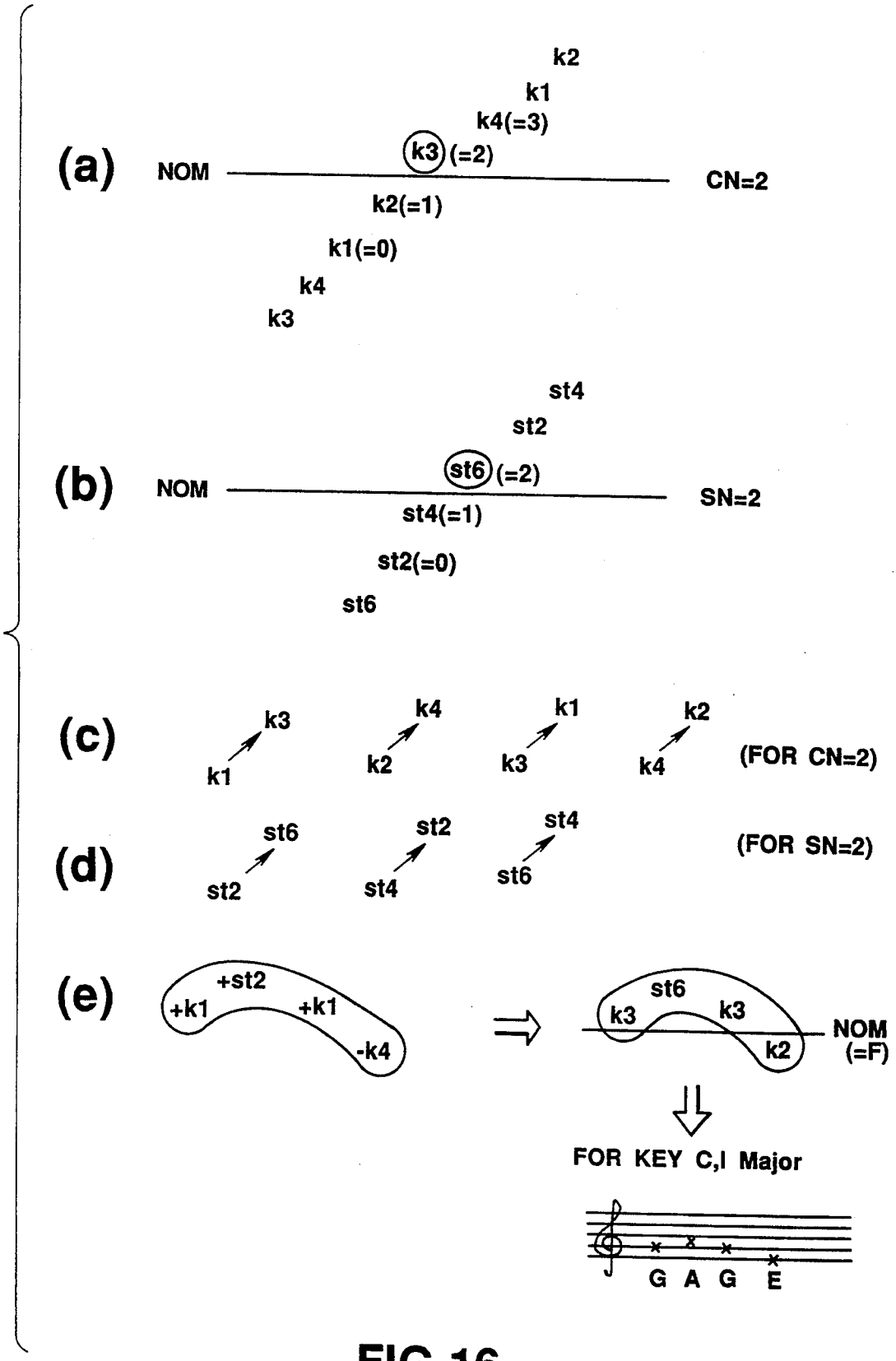
FIGS. 16(*a*)–16(*e*) illustrates how a note type succession is converted.

FIG. 16 graphically illustrates the operation of the note type succession converting process. In part (a), a chord member directly above the reference pitch is the third chord member k3 counted from the chord root which is denoted by k1. The representation of note types k1 to k4 and st2 to st6 shown in parts (a) and (b) is commensurate with the note type definition of the pitch class translation table AV, according to which the chord root is the first chord member k1.

As illustrated in part (a), if the chord member directly above (including the same pitch as) the reference pitch NOM is the third chord member k3, CN is set equal to 2. The detection of the chord member and storing CN number is done at step 15-2 in FIG. 15. In part (b), a scale note immediately above NOM is st6. Thus, SN is set equal to 2. It is step 15-4 which detects such scale note and sets SN. For CN=2, the chord member types are converted as illustrated in part (c). That is, k1 is converted into k3, k2 to k4, k3 to k1 and k4 to k2. Here, each chord member type before the conversion is a relative note type in relation to the reference pitch NOM, while each chord member type after the conversion is a note type commensurate with the definition of the pitch class translation table AV. For SN=2, scale note types are converted as illustrated in part (d). Specifically, st2 is converted to st6, st4 to st2 and st6 to st4. Part (e) illustrates a note type succession of (+k1, +st2, +k1, −k4) before the conversion, a note type succession of (k3, st6, k3, k2) after the conversion and a translated pitch succession. In the converted note pitch succession, the first note type is a chord member directly above the reference pitch NOM, the second note type is a scale note directly above NOM (in the scale note set), the third note type is a chord member directly above NOM, and the fourth note type is a chord member directly below NOM. The converted note type succession is described here in relation to the reference pitch NOM, as exactly indicated by the note type succession (+k1, +st2, +k1, −k4) before the conversion.

It will be understood from the foregoing that the convert note type succession process FIG. 15 makes distinction between chord members and scale notes.

In place of the note type succession converting process of FIG. 15, a look-up table memory may be used which returns a note type having representation compatible with the pitch class translation table AV in response to a two-argument combination in which the first argument is the pitch interval of NOM from chord root, and the second argument is a note type from the relative note type succession table. Clearly, such look-up table (note type conversion table) promptly executes note type succession converting.

The note type succession converting process of FIG. 15 assumes that the chord member number is 4 and that the scale note number is 3. To handle other than 4 chord members (e.g., 3) and/or other than 3 scale notes (e.g., 4), the converting process may be modified such that it has a plurality of branching subroutines each handling a different number combination of the chord members and scale note members. The tonal harmony information contained in the tonality index may be used to select which subroutine is to be called. This arrangement will provide improved conversion.

The convert into pitch succession step 14-3 (FIG. 4) converts the note type succession translated in step 14-2 into a pitch succession by using the pitch class translation table AV.

FIG. 9 illustrates the pitch class translation table AV. The table AV returns a pitch class of note type in a chord root of C (i.e., pitch interval from chord root) in response to two arguments in which the first argument is given by the chord function (tonal harmony) contained in the tonality index, and the second argument is given by the note type translated by the process 14-2. Since the pitch class translation table AV defines the chord number type k1 as chord root, as stated earlier, the data shown in the k1 column is actually omitted from the table AV. In a modification, data in the table AV represents a pitch interval of note type, not from chord root but from keynote. Then, the modified table AV does contain data in k1 column, indicative of pitch interval of chord root from keynote. A data output from the modified table AV is combined by a modulo 12 summer with the keynote pitch class rather than the chord root pitch class.

FIG. 17 is a detailed flow chart of the convert into pitch succession step 14-3 in which the pitch class translation table AV is looked up.

First (17-1), CPU 2 retrieves the octave of the reference pitch i.e., last measure ending pitch NOM, and loads it into OCT. At 17-2, a phrase note counter j is set to 1. In the loop of 17-3 to 17-14, at the entry 17-3, CPU 2 sets a note type register NT to a converted note type item of TDN (i, j), and sets a direction flag F to a direction item of TDN (i, j). At 17-4, NT and the chord function (tonal harmony in the tonality index) are used to look up the table AV, the looked-up data being loaded into P. At 17-5, CPU 2 adds the pitch class of the note type NT (specified in the current measure tonality) to the NOM octave OCT by P=(P+root) mod 12+OCT. The resultant pitch P is compared with the reference pitch NOM (17-6). At each of steps 17-7 and 17-10 branching from 17-6, the direction F is checked. If P<NOM (17-6) and if F="−" (17-10), then P indicates the desired pitch of the note of interest. Thus, the current pitch element P(i, j) of the phrase pitch succession array is set equal to P (17-11). If P<NOM (17-6), and if F="+" (17-10), P is raised by one octave (P+12) to specify P(i, j), at 17-12. If P>NOM (17-6) and if F="+" (17-7), then P indicates the desired pitch. Thus, the current pitch element P(i, j) of the phrase pitch succession array is set equal to P (17-8). If P>NOM (17-6), and if F="−" (17-7), P is lowered by one octave (P-12) to specify the pitch P(i, j), at 17-9. At step 17-13, if the end of the phrase has not been reached, j is incremented (17-14), returning to the loop entry 17-3. If the end of the phrase has been reached (17-13), this indicates that the phrase pitch succession has been completed. Thus, the ending pitch P(i, j) in the current phrase pitch succession is set to NOM in preparation for the pitch succession conversion with respect to the next measure phrase.

Figure 18:
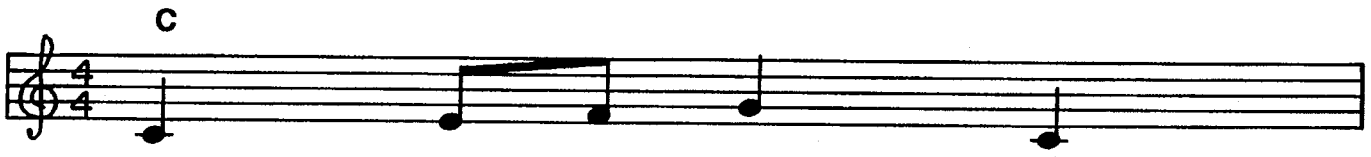
FIG. 18 is a musical staff illustrating a theme.

FIG. 18 illustrates a theme or motive example. A theme record in the theme bank contains data representative of the theme illustrated.

Figure 19:
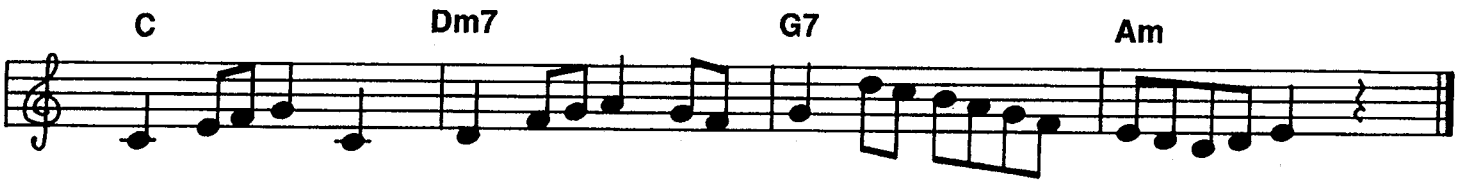
FIG. 19 is a musical staff illustrating a composed melody.

FIG. 19 illustrates a composed melody example by the present automatic melody composer. The composed melody extends over second to fourth measures. The first measure is occupied by the theme (motive) illustrated in FIG. 18.

Having finished the melody composition, the system automatically plays the composed melody (4-9 in FIG. 4).

As understood from the foregoing description of the first specific embodiment with respect to FIGS. 3 to 19, the present automatic melody composer composes a melody by relying on the music database. The music database includes the phrase database containing several look-up tables or files RCL, RPD, NGD and AV, and the melody generating index table or file CED. The musical data unit in the phrase database is a phrase, not a single note or separate notes to enable the automatic composer to compose a melody on a phrase by phrase basis. The generating index record, which is associated with the phrase database, directs how to develop, modify or repeat what phrase and phrases into a melody formed in a chain of such phrases. Therefore, the present automatic melody composer provides an extensive space of melody composition. A composed melody is natural. The melody composing program residing in ROM 4 does not require a complicated or time-consuming data processing, thus shortening an amount of time required for melody composition. It is expected that when a request for automatic composition is made by a user, the automatic melody composer composes a melody in a real-time or almost real-time enviromnent and automatically plays the composed melody as a response to the user.

The automatic melody composer of the first specific embodiment does not, however start to play the composed melody before the entire melody composition has been finished. This can cause a problem of overhead or waiting time required from the user's request to the start of melody play, depending on the performance and speed of a computer system on which the automatic melody composer is implemented. The waiting time also depends on the number of musical time units (e.g., measures) of a melody to be composed. For a melody of, any, 64 measures, an automatic melody composing computer, which is capable of composing a one-measure melody only in one second, requires 64 seconds to complete 64-measure melody. A waiting time of a couple of seconds should be satisfactory to the user. However, a waiting time about one minute is unlikely to be accepted as real-time.

A automatic melody performing process is typically done in a cyclic time routine which is periodically called per musical resolution time unit (e.g., 1/96 of one measure time). One solution for reducing the waiting or overhead time would be to modify the cyclic time routine so as to handle the melody composing process before the automatic melody performing process such that the latter process promptly plays a note having just been composed. However, with this system, the data processing is distributed unequally with respect to time and can be concentrated at the measure start since when a new measure begins, the melody composing process must create those pieces of information determining a phase of the new phrase, and generate pitch data of a note to be played at the first beat of the new measure if any. This will bring about a first note of the measure played with a delay, seriously damaging the automatic melody performance.

The second specific embodiment to follow discloses an automatic melody composer capable of composing and performing a melody in real-time irrespective of the melody length.

Second Embodiment

Figure 20:
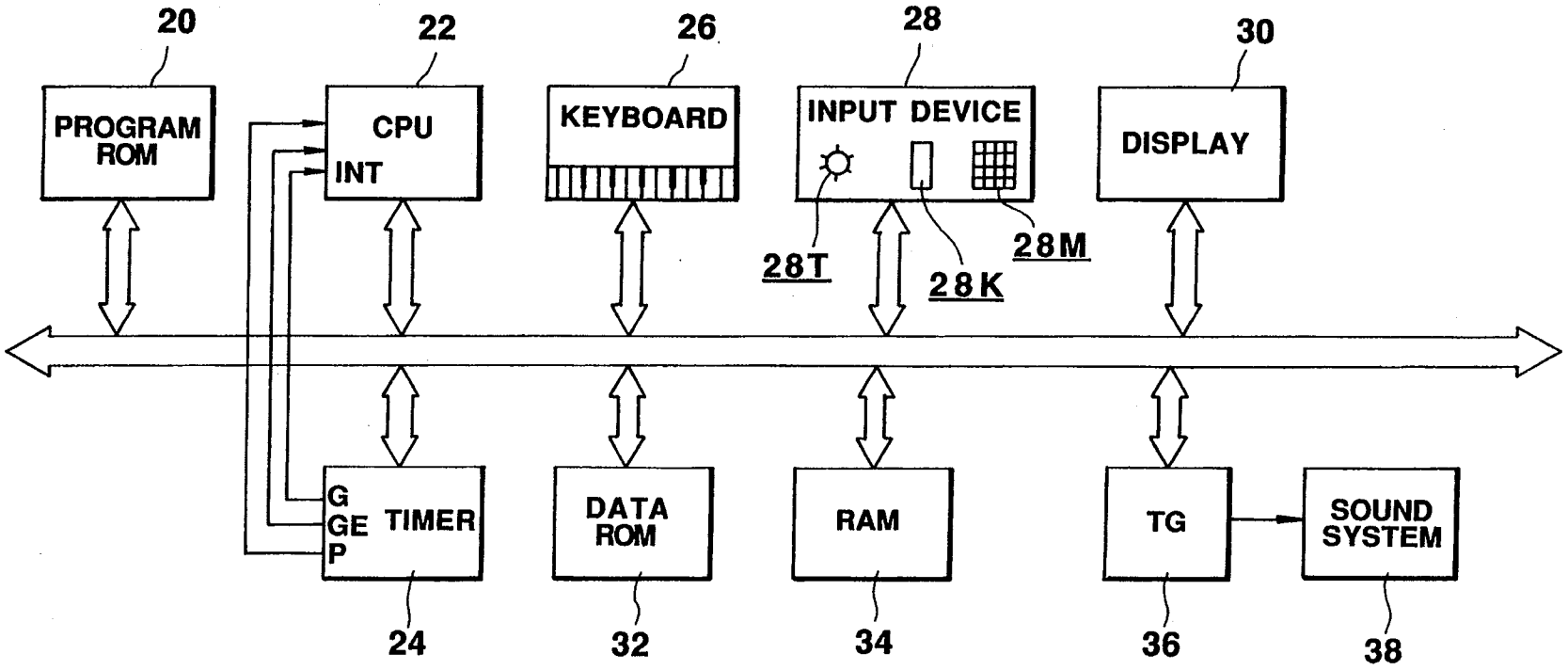
FIG. 20 is a block diagram of a representative hardware organization in which a second specific embodiment of the automatic melody composer is implemented.

Hardware Organization (FIG. 20)

FIG. 20 is a block diagram of a representative hardware organization in which the second specific embodiment of the automatic melody composer is implemented. In FIG. 20, RAM 34, tone generator 36, sound system 38, musical keyboard 26, input device 28 and display 30 may be physically identical with RAM 6, tone generator 12, sound system 14, display 16, input device 10 and display 16, in FIG. 3, respectively. CPU 22 has performance level, which assures, when the real time control system to be described is employed, a perfect real-time response. Specifically, the computer performance is such that the automatic composing process is able to compose a melody segment of one measure (musical time unit) during the period in which the automatic melody performing process plays a one-measure melody segment. It is noted, however that this performance requirement is within the ability of typical microcomputers. The program ROM 20 stores programs to be executed by CPU 22. The data ROM 32 stores permanent data including the theme table, melody generating index table and phrase database such as described with respect to the first specific embodiment. The timer 24 is a programmable timer, the time data of which can be variably set by the database. The timer 24 generates three different interrupt request signals INT each at G time, GE time and P time. Each interrupt request signal is supplied to CPU 22.

The present automatic melody composer has three processes (processing systems) of main (M) process, melody composing or generating (G) process and automatic performing (P) process. In this regard, the program ROM 20 contains the main program dealing with M process, the melody generating program (G-interrupt routine) handling G process and automatic performing program (P-interrupt routine) concerning P process.

Real Time Control System (FIGS. 21–24)

The real-time control system involved in the present automatic composer will now be described in conjunction with FIGS. 21 to 24.

Figure 21:
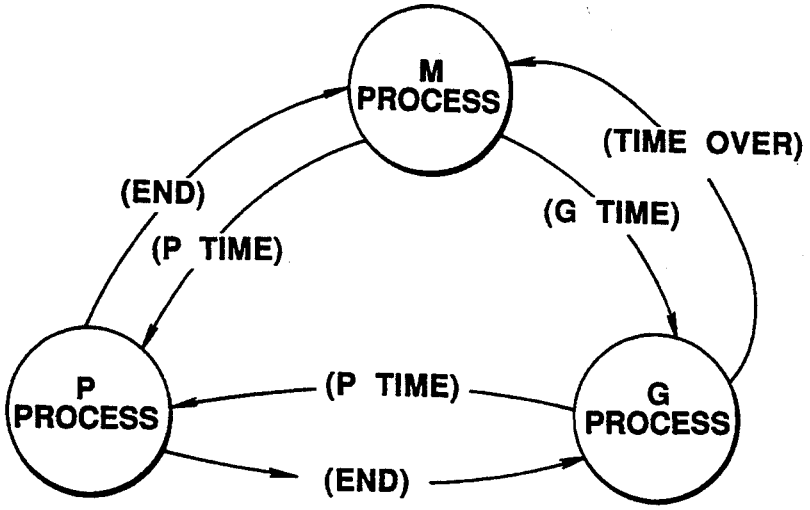
FIG. 21 is a system state transition map of the second embodiment.

FIG. 21 shows a map of system state transitions of the composer system. Suppose that the composer system is in the state of M process. That is, M process is active, occupies or controls CPU 22, or CPU 22 is executing the main program. The arrival of G time causes a system state transition from the state in which M process is active to the state in which G process is active. Thus, the main program being executed is now interrupted by a G time interrupt request signal from the timer 24 so that the melody generating program is, in turn, executed by CPU 22 for G process. G process is not allowed to occupy CPU 22 unlimitedly, but stops when the assigned time is over, returning the system to the M process state. That is, the melody generating program being executed is now interrupted by a GE time interrupt request signal from the timer 24 so that the main program resumes control of CPU 22 to go on M process from where it was stopped. Arrival of P time causes a system state transition from the state in which M process is active to the state in which P process is active. Thus, in response to a P time interrupt request signal from the timer 24, the running melody generating program is interrupted so that CPU 22 is now controlled by the automatic melody performing program for P process. No time limit is assigned to the automatic melody performing program which is thus run completely since the run time of the automatic melody performing program is Very short. The P process state that was transferred from G process at P time returns to G process state in response to the end of P process. The P process state that was transferred from M process state at P time returns to M process state when P process finishes.

Figure 22:
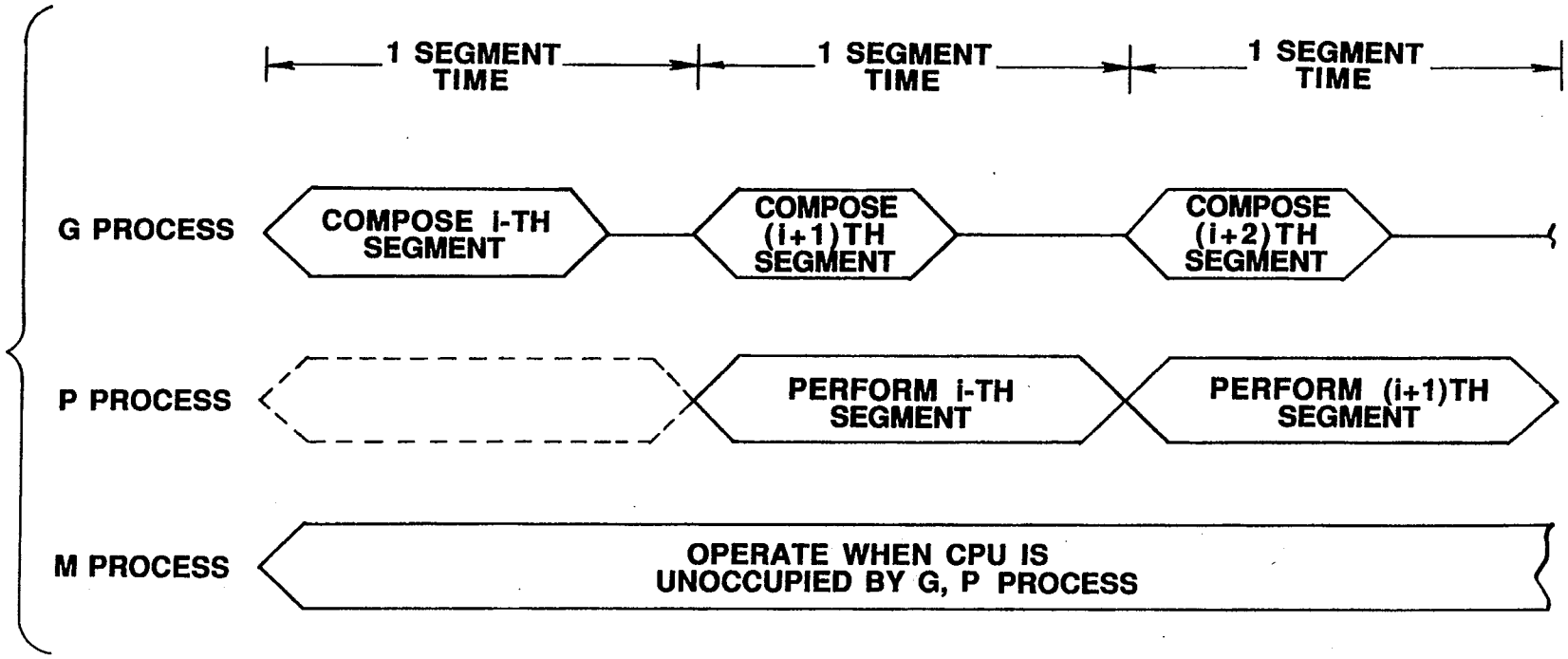
FIG. 22 is a time chart illustrating the pipeline control feature of the second embodiment.

The time chart of FIG. 22 illustrates that the real-time control system involves a pipeline control feature using a single CPU (i.e., CPU 22). G process composes an i-th melody segment or phrase within a one segment time (musical time unit or one measure time). Within the next segment time, P process performs the i-th melody segment previously composed by G process which is now composing the next or (i+1) -th melody segment. Thus, G and P processes are pipelined such that the product (phrase) by G process in a time interval is transferred and further processed (played) by P process in the next time interval. Meanwhile, M process operates in a time shared manner when CPU 22 is not occupied by G or P process.

FIG. 22 is a process chart of the real-time control system. Initially, the main program is executed by CPU 22. At a time corresponding to point P1, the timer 24 generates a G time signal. An instruction M1 in the main program being executed is finished. Then, the main program is interrupted so that the control of CPU 22 is transferred to the melody generating program (G interrupt). G interrupt occupies CPU 22 during an assigned time quantum T, and is thus executed for T. The assigned time quantum T is measured by a time interval from G time signal generating point to GE time signal generating point. At point Q2, GE time has arrived. Then, G routine is interrupted when an executing instruction G2 is finished to transfer the control of CPU 22 back to the main program. CPU 22 restarts the main program from the instruction next to M1 instruction. Thereafter at point P3, a GE time has come again, causing G interrupt routine to take control of CPU 22. Thus CPU 22 restarts G interrupt routine from the instruction next to the last instruction G2. G interrupt routine is executed until the assigned time quantum T has elapsed. Then the control of CPU 22 is resumed by the main program. At point PS, a next G time has come. This again causes transfer of CPU 22 control from the main program to G interrupt or automatic melody generating program at Q5. Before the assigned time quantum T has elapsed, the timer 24 can generate a P time signal. This is indicated by point Q6. Then, G interrupt routine is interrupted at the finish of the executing instruction G6 so that the control of CPU 22 is now transferred to the automatic melody performing program (P interrupt routine) at R1. P interrupt routine finishes at R2. Then, G interrupt routine resumes the CPU 22 control and restarts with the instruction next to G6 instruction, as indicated at QT. Thereafter, when the next GE time has come, the control of CPU 22 is transferred back to the main program. The timer 24 can generate a P time signal in the system state in which the main program is running, as indicated at point PT. Then, the main program is interrupted to transfer the control of CPU 22 to routine at R3. At point R4, P routine finishes.

Figure 24:
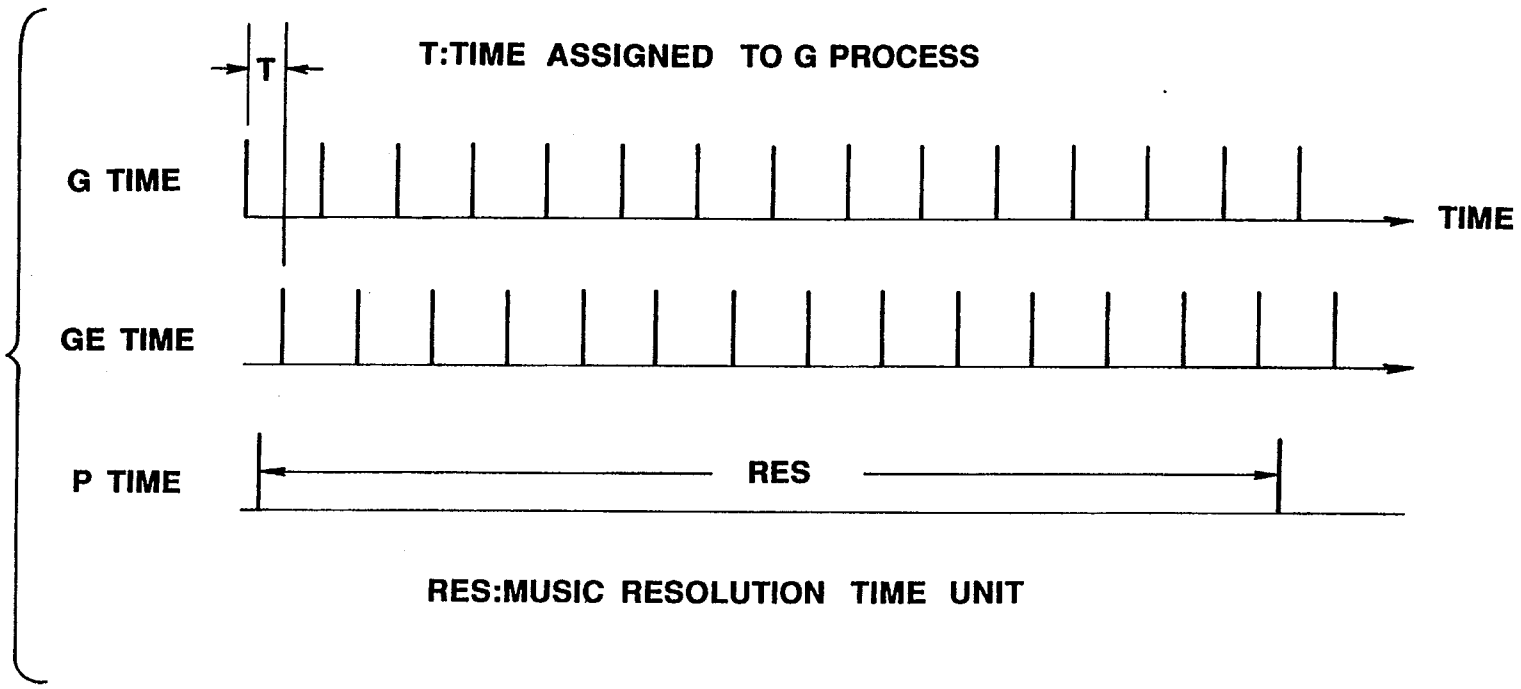
FIG. 24 is a time chart illustrating the time sharing feature of the second embodiment.

The time chart of FIG. 24 illustrates a time sharing multi-processing feature of the real-time control system. The timer 24 generates a G time pulse upon each arrival of G time, as indicated in FIG. 24. Further, upon each arrival of GE time, the timer 24 generates a GE time pulse as indicated in FIG. 24. Each time when a P time has come, the timer 24 generates a P time pulse as indicated in FIG. 24. The time interval T from a G time pulse to a GE time pulse specifies the time quantum assigned to the melody generating process (G process). The assigned time quantum T may be fixed in a composer system having a sufficient margin from the overall processing. However, in a relatively low speed composer system, it is preferred to vary the assigned time quantum T depending on performance tempo. The main program or M process takes the control of CPU 22 in each time interval from GE time to next G time. The main program handles input and output (I/O) of the electronic musical instrument, response of which must be provided promptly. Thus, the main program is executed on a time-shared basis when the instrument is in the automatic composer mode of operation. It may occur, however, that the main program does not handle the I/O processing completely, depending on the performance level of CPU 22. In such case, the main program may be designed such that during the automatic composer mode, some unimportant portions of the main program are skipped. One complete cycle time of the main program, which determines an input-to-output response of the electronic musical instrument, may be considered to determine G or GE time pulse repetition rate. In the system environment in which the amount of data to be processed in G and M processes is much larger than that in P process, G or GE time pulse repetition rate should be much higher than P time repetition rate. The P time pulse repetition rate or period defines the music resolution time unit RES. Of course, the music resolution time unit RES is in inverse proportion to the performing tempo. For example, double the tempo, halve the music resolution time unit RES.

For the computer-based composer system, whose performance level is critical to the melody generating process (G process), it is highly advantageous to vary the time quantum T assigned to G process as a function of music performing tempo. The net time taken by G process to compose a melody is independent of the performing tempo. It is noted, however that the present real-time control system employs pipeline control of G and P processes, as discussed in connection with FIG. 22. P process receives and performs a melody segment previously composed by G process while at the same time G process composes the next melody segment. The melody performance by P process depends, of course, on the performing tempo. Thus, one segment time (one measure time) shown in FIG. 22 is in inverse proportion to the performing tempo. On the other hand, the time required by G process to compose a melody segment (phrase) depends not on one segment time but on the phrase generating index information and/or number of notes of the phrase. Thus, for the system having critical performance with respect to the melody generating process, the time quantum T assigned to G process should be extended for higher tempo to achieve the pipeline control of FIG. 22. To this end, the main program may contain a timer setting routine which causes CPU 2 to set the timer 24 to the tempo-dependent time data of G time. The worst-case time for G process to compose a phrase depends primarily on the phrase generating index information. The worst-case time data may preferably be included in each phrase generating record so that the assigned time quantum T is computed from the worst-case time data in view of the current tempo.

The pipeline control of FIG. 22 assumes that the system can complete a one melody segment composition within the performance time of a one melody segment, at all times including the worst-case. For the system having more critical performance level, it is desired that G process operates more continuously under the time-sharing control. The time for G process to complete a phrase composition varies with phrases. Such variations can be absorbed by operating G process continuously under the time-sharing control so that a melody is continuously composed. The system requirement is to keep the performance tempo. Thus, G process must complete generating of a note before P process plays it at the desired timing commensurate with the correct tempo.

With the present real-time control system, a computer-based composer with a relatively low computer performance can most promptly compose and play a melody to thereby provide a real-time environment of music composition.

The present real-time control system is characterized by a computer-based system having a single GPU which performs multi-processes of the main, melody generating, and playing processes under the control of pipelining and time-sharing to provide real-time system response.

Details (FIGS. 25 to 47A–C)

The second embodiment is now described in more detail with reference to FIGS. 25 to 47A–C.

Figure 25:
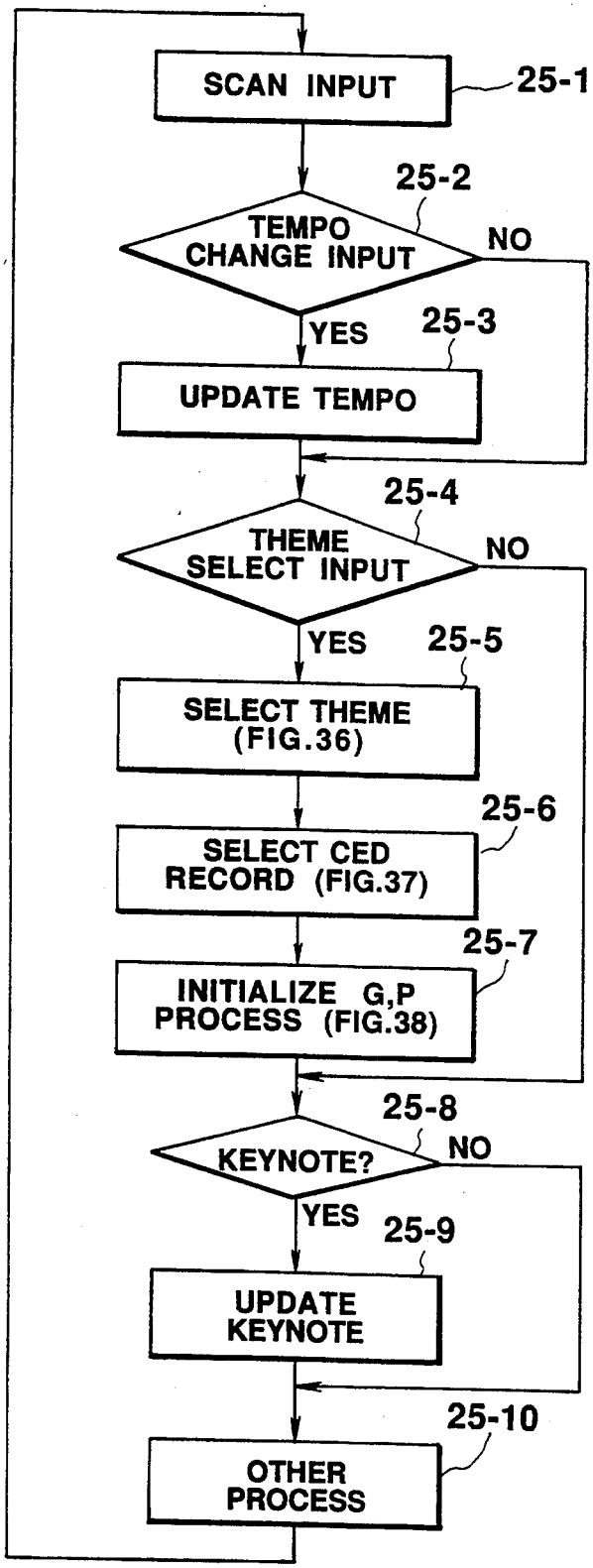
FIG. 25 is a flow chart of the main process.

FIG. 25 is a flow chart of M process (main program). In block 25-1, the main program controls CPU 22 to scan the input device 28 and the musical keyboard 26. Then, the main program causes CPU 22 to check respective states of the scanned input device and keyboard to perform corresponding processes. Among the processes, blocks 25-2 to 25-9 are associated with the automatic melody composing. Other processes are represented by block 25-10.

Specifically, if a tempo change input from the tempo volume 28T is received (25-2), CPU 22 updates the tempo by setting a tempo register in RAM 34 to new tempo data corresponding to the position of the tempo volume 28T (25-3). If a theme select input from the tempo selector 28M is received (25-4), CPU 22 performs a select theme routine (FIG. 36) at 24-5, a select CED record routine (FIG. 37) at 25-6 and an initialize G, P routine (FIG. 38) at 25-7. In doing so, G and P processes are enabled so that the melody composing and performing starts. Thus, the theme select input is a request for automatic melody composing and performing. If a new keynote input from the transpose key 28K is detected (25-8), CPU 22 updates the keynote (25-9) by setting a keynote register in RAM 34 to the new keynote data.

There may be provided a key scanner hardware interface for scanning the input device 28 and the keyboard 26 to reduce the work load of CPU 22.

Figure 26:
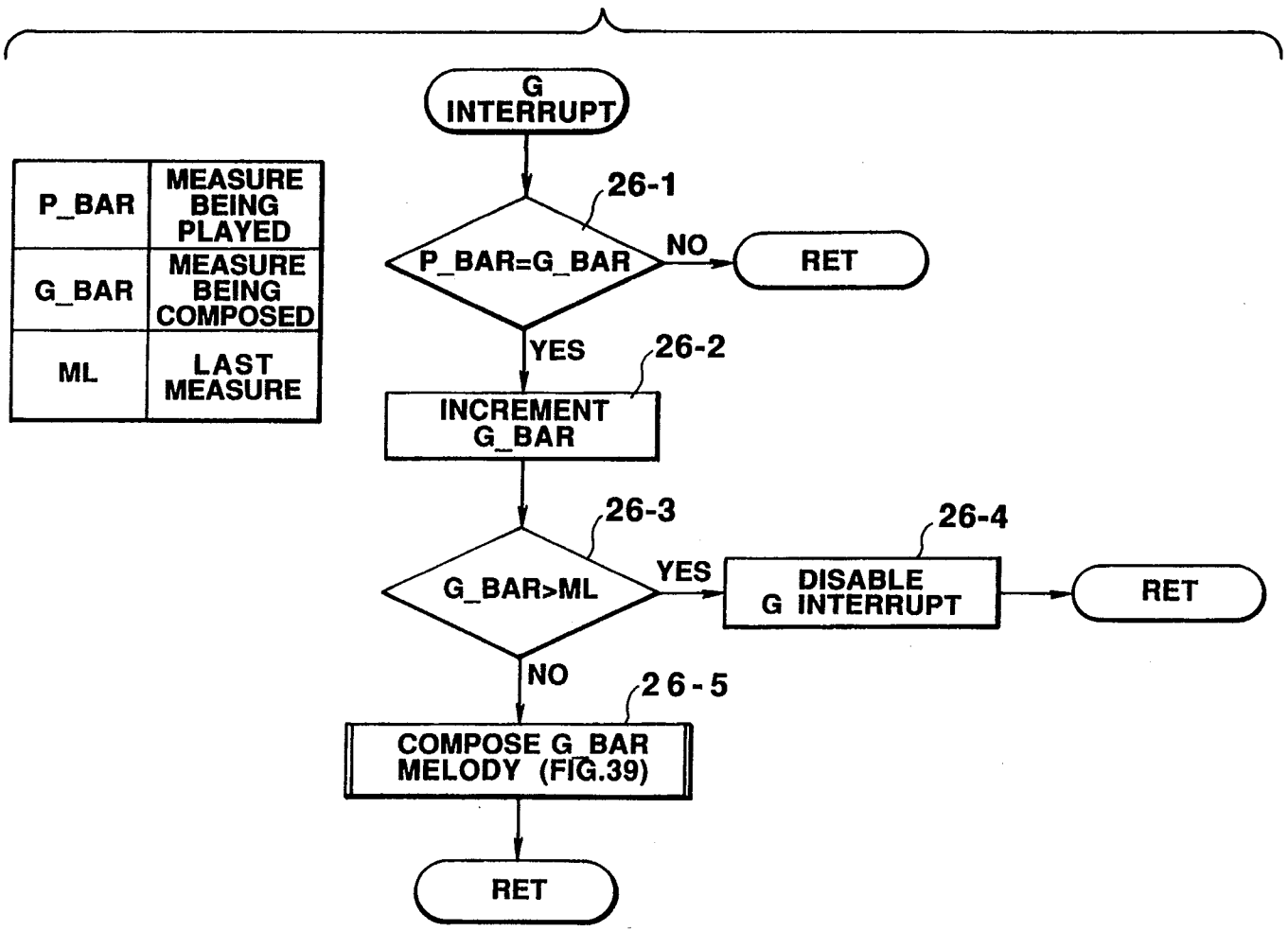
FIG. 26 is a flow chart of the G-interrupt process.

FIG. 26 is a flow chart of G process interrupt program). At the entry 26-1 of interrupt program, it is checked as to whether P_BAR=G_BAR i.e., whether the measure currently played by the melody performing process P, referred to a playing measure, the same as the measure currently composed by the melody generating process G, referred to a composing measure. If the playing measure is placed before the composing melody, G process does not yet have to start composing a new measure phrase (see FIG. 22), and thus returns directly. If P_BAR=G_BAR, G process must finish composing of the next measure melody before P process starts to play that measure. Thus, G interrupt program or G process increments the composing measure number G_BAR at 26-2 and composes G_BAR melody at 26-5. If no further measure to be composed remains i.e., if melody composition of the last measure in the generating index record has been finished, G_BAR>ML (ML indicates the last measure of melody) is detected at 26-3, Then G process disables or masks G interrupt program at 26-4 to terminate the G process, and returns. Thus, CPU 22 will ignore a subsequent G time interrupt request signal from the timer 24 so that it continues running of the main program.

Figure 23:
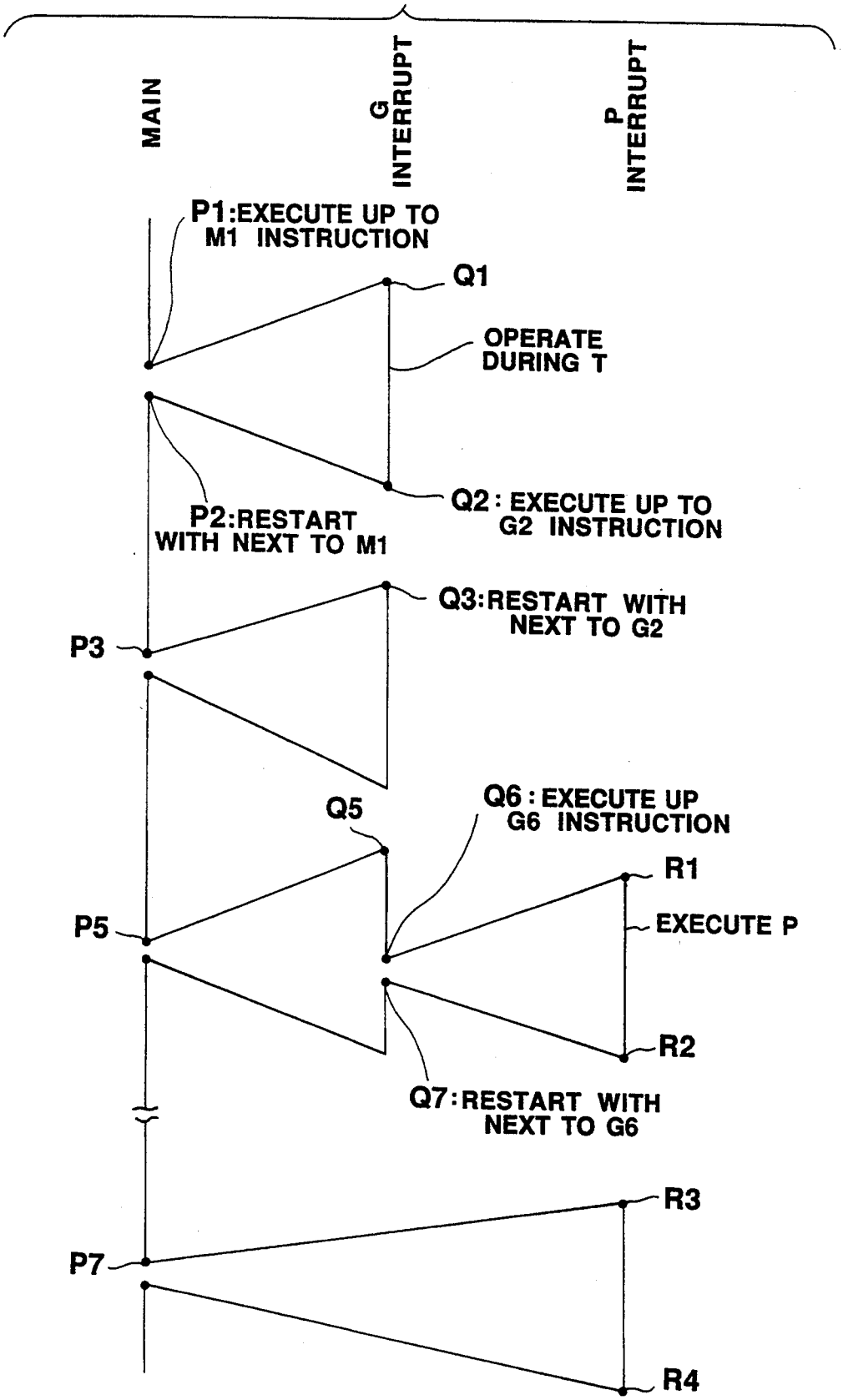
FIG. 23 is a process chart illustrating the execution path of three processes of main, G-interrupt and P-interrupt in accordance with the second embodiment.

As mentioned earlier, the time assigned to process is limited to the time quantum T (see FIG. 24). When the assigned time is up, indicated by a GE pulse from the timer 24, G process is interrupted and M process becomes active (running state of the main program) according to the system state transition map of FIG. 21. A P time signal from the timer 24 also causes interrupting G process and transfer of CPU 22 control to the melody performing program. Thus, G interrupt program is executed bit by bit or fragment by fragment, as shown in FIG. 23. Not all processes shown in FIG. 26 are completed within the assigned time T.

Figure 27:
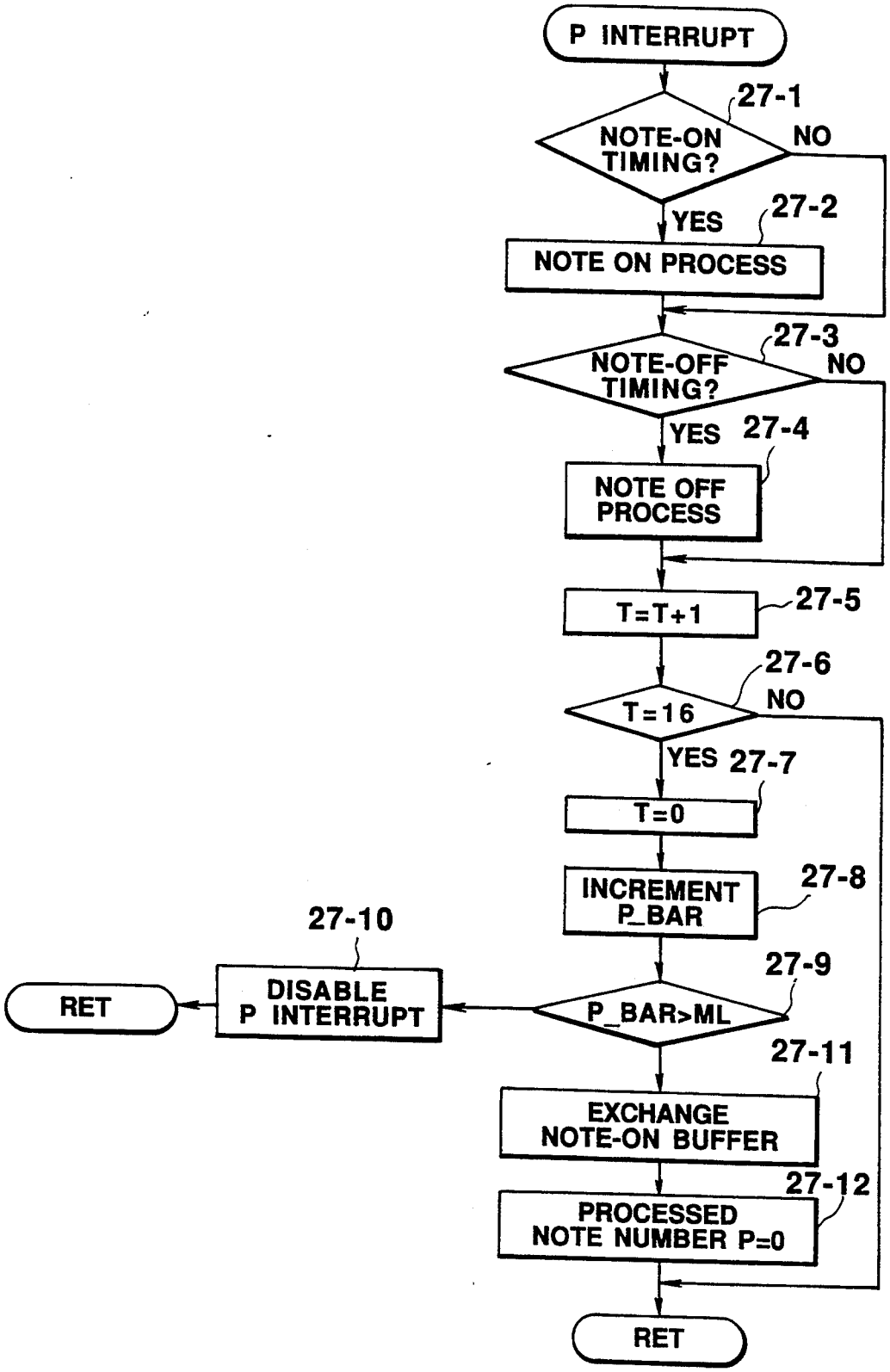
FIG. 27 is a flow chart of the P-interrupt process.

FIG. 27 is a flow chart of P process (melody performing program). The melody performing program,once given the control of CPU 22, is completely executed and returns to the interrupted program. The melody performing program is initiated immediately after a P time interrupt request signal from the timer 24 (when CPU 22 has completed the operation of the executing instruction in the program to be interrupted and has saved into a return address register the next instruction address from which the interrupted program will restart). First (27-1), it is checked as to whether a note-on timing has come. In the affirmative, CPU 22 performs note-on protests 27-2 by sending a note-on command to the tone generator 36. At 27-3, it is checked as to whether a note-off timing has come. In the affirmative, CPU 22 executes note-off process 27-4 by sending a note-off command to the tone generator 36. At 27-5, CPU 22 increments a register T in RAM 34 for counting P time signal pulses from the timer 24. In the present embodiment, the music time resolution number per measure is 16. Thus, if T=16 (27-6), T is initialized to 0 indicative of start of a new measure (27-7), and the playing measure number P_BAR is incremented (27-8). At 27-9, it is checked as to whether P_BAR>ML, i.e., whether there remains no measure to be played. If there remains a measure to be played, CPU 22 exchanges the note-on buffer (27-11) and initializes the processed (played) note count P to 0 (27-12). If P_BAR>ML(27-9), the whole melody (composed based on the generating index record) has been played. Thus, CPU 22 disables P interrupt program (27-10) to terminate P process, and returns to the interrupted program. Thus CPU 22 will no longer accept a P time interrupt request signal from the timer 24 so that the melody performing program will not be called.

Figure 28:
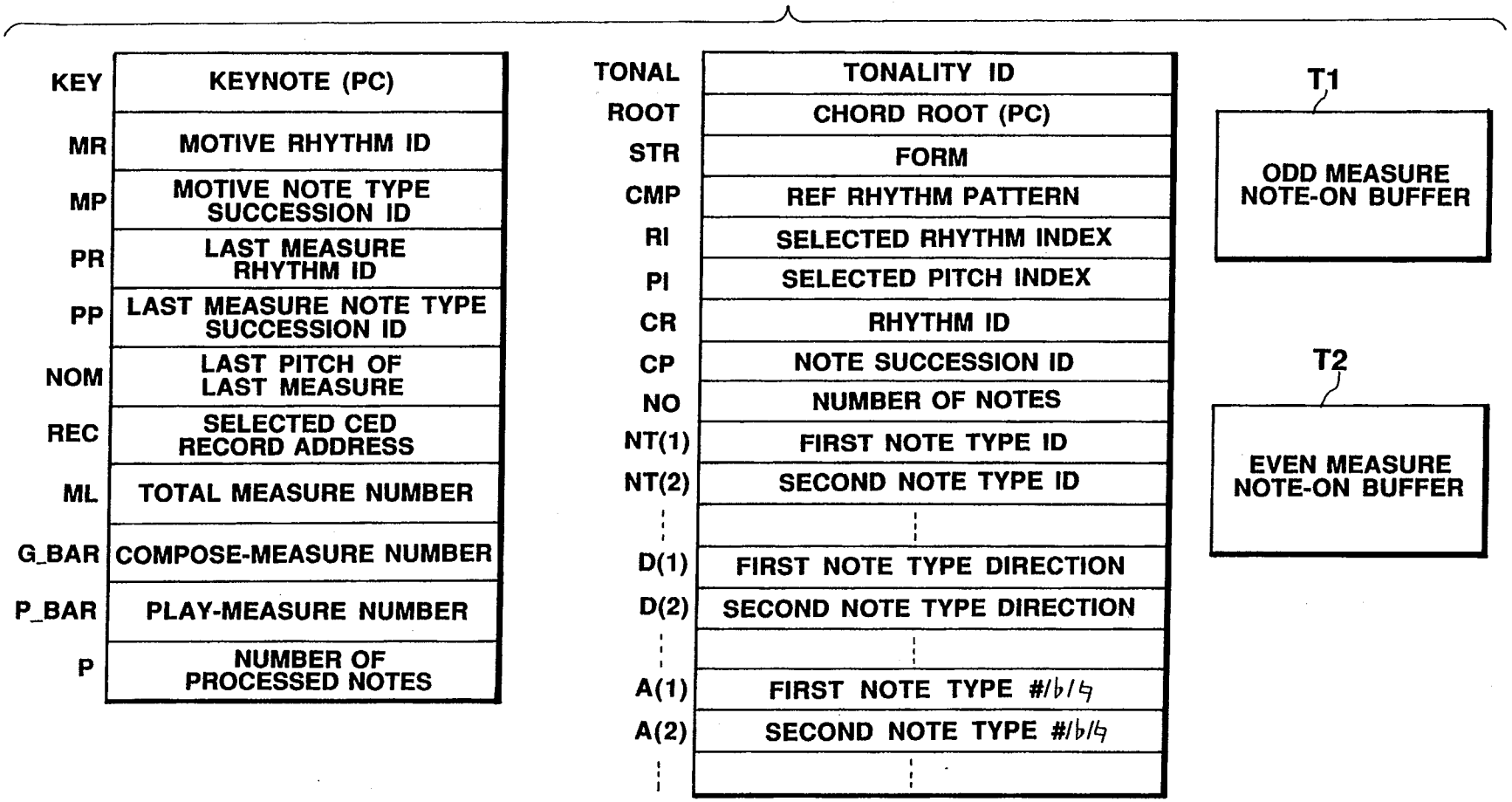
FIG. 28 shows main variables used in the second embodiment.

FIG. 28 shows main registers or variables involved in the automatic melody composing and performing. These registers all reside in RAM 34. Register KEY stores a keynote pitch class. Register MR stores motive (selected theme) rhythm identifier. Register MP stores motive note type succession identifier Register PR stores last (previous) measure rhythm pattern identifier. Register PP stores last measure note type succession identifier Register NOM stores last measure ending pitch. Register REC stores selected CED record address. Register ML stores measure number of selected CED record. Register G_BAR stores composing measure number as stated earlier. Register P_BAR stores playing measure number as already mentioned. Register P stores processed note count in the playing measure.

Contents of these registers are initialized in blocks 25-5, 25-6 or 25-7 of the main program (M process). G process changes or updates the last measure rhythm identifier PR, last measure note type succession identifier PP, last measure ending pitch NOM, and composing measure G_BAR at appropriate times during the enabled period of G process. Thus, the melody Generating program has write-access to these variables or registers. Any other process does not Gain write-access to these registers during the enabled period of G process. P process updates the playing measure number P_BAR and processed note count P at appropriate times during the enabled period of P process. Only the melody performing program has write-access to the registers P_BAR and P during the enabled period of P process.

Register (variable) TONAL stores (indicates) tonality identifier. Register ROOT stores chord root pitch class. Register STR stores form. Register CMP stores reference rhythm pattern number (identifier). Register RI stores selected rhythm index. Register PI stores selected pitch index. Register CR stores rhythm identifier. Register CP stores note type succession identifier. Register NO stores note number. Register NT(1) stores the first note type identifier or name, register NT(2) stores the second note type identifier and so on. Register D(1) stores the first note type direction, register C(2) stores the second note type direction, and so on. Register A(1) stores accidental of the first note type, register A(2) stores accidental of the second note type, and so on.

All these registers:relate to the measure currently composed and pointed to by G_BAR. For example, TONAL indicates tonality identifier of G_BAR. Contents of the registers TONAL, ROOT and STR are retrieved from the G-BAR phrase index information contained in the selected melody generating index (CED) record. The register R1 is loaded with one of the rhythm index candidates (instances) concerning G_BAR and contained in the selected CED record, as the selected rhythm index for the current measure G_BAR. Similarly, the register PI is loaded with one of the pitch index candidates concerning G_BAR and contained in the selected CED for the composing measure G_BAR. The reference rhythm pattern identifier CMP is obtained by applying form STR to the look-up table RCL. The rhythm identifier CR identifies the rhythm of the current measure G_BAR. The note type succession identifier CP identifies the relative note type succession of the current or composing measure G_BAR. The note number NO is the number of notes of the current measure. Those registers of note type identifier, direction and accidental are initialized to note type data elements of note type succession retrieved from the relative note type succession table. The note-on buffer comprises two buffers T1 and T2. While G process writes composed melody note data into the first note-on buffer T1, P process reads data from the second note-on buffer T2 to play the melody. When a one-measure time has elapsed, G and P processes exchange the buffers T1 and T2.

Figure 29:
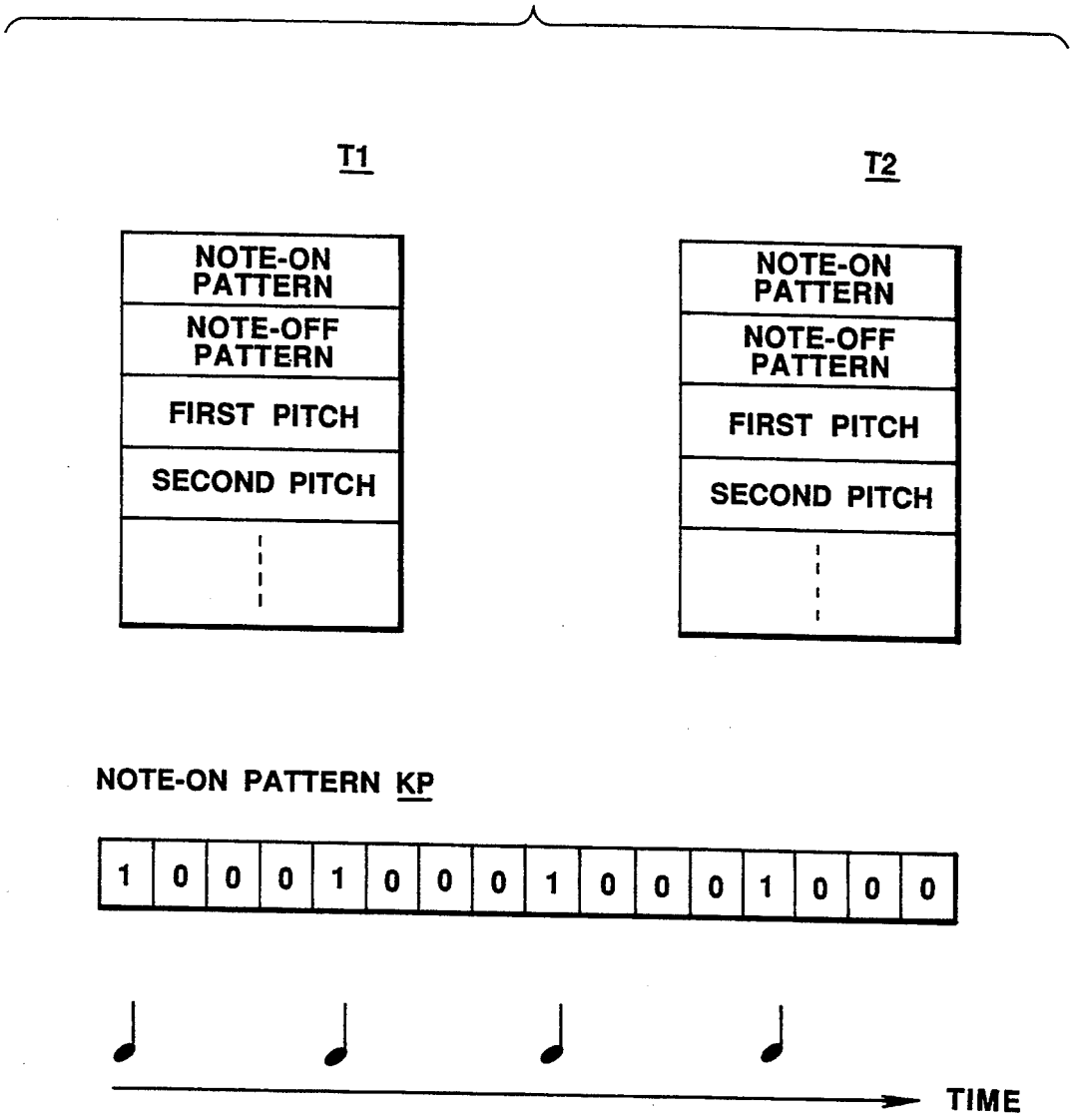
FIG. 29 shows double note-on buffers.

FIG. 29 illustrates the two note-on buffers T1 and T2 more specifically. The first note-on buffer T1 is used for odd measure melody performance whereas the second note-on buffer T2 is used for even measure melody performance. Each note-on buffer contains a one word of note-on pattern, a one word of note-off pattern and plural words of pitches as many as the measure note number. Lower part of FIG. 29 shows a note-on pattern word KP in the case of 16 bits/word. Each bit position in the 16-bit word indicates a corresponding one of the sixteen timings with an equal span of one-sixteenth of one measure. A bit having "1" value indicates a note-on event. Thus, the illustrated note-on pattern word of:

1000100010001000 indicates that a measure has four note-on events occurring at the first, second, third and fourth beats. The format of the note-off pattern word is the same as that of the note-on pattern word. In this example, one measure is subdivided into sixteen equal parts, meaning the music time resolution of 16/measure. For the music resolution of 48/measure, a note-on pattern (in a measure) is represented by three 16-bit words.

The rhythm data in the note-on and off pattern words, which is loaded by G process for initialization, is shifted left by one bit in P process each time when the music resolution time unit has passed i.e., each time the automatic melody performing program is called and executed in response to a P time signal from the timer 24. By checking a carry, it can be determined whether a note-on or off timing has come.

The description now turns to a memory configuration for realizing the database of the present melody composer, such as theme bank, melody generating index table CED, reference rhythm table RCL, rhythm table RPD, relative note type succession table NeD and pitch class translation table AV. A search argument must be determined and used to get access to an individual table in the database. This does not, however, necessarily mean that the table memory to be searched stores keywords for matching against the search argument. To save storage capacity of table and speed up the table search, it is preferred that an address in the table memory where a data item to be looked up is stored is directly computed from a given search argument without requiring keyword area in the table memory. The respective tables described in the following are configured according to the principle. In the case where each table record contains a keyword, it is desirable that table records are arranged in keyword number increasing order to enable quick search such as binary search.

Figure 30:
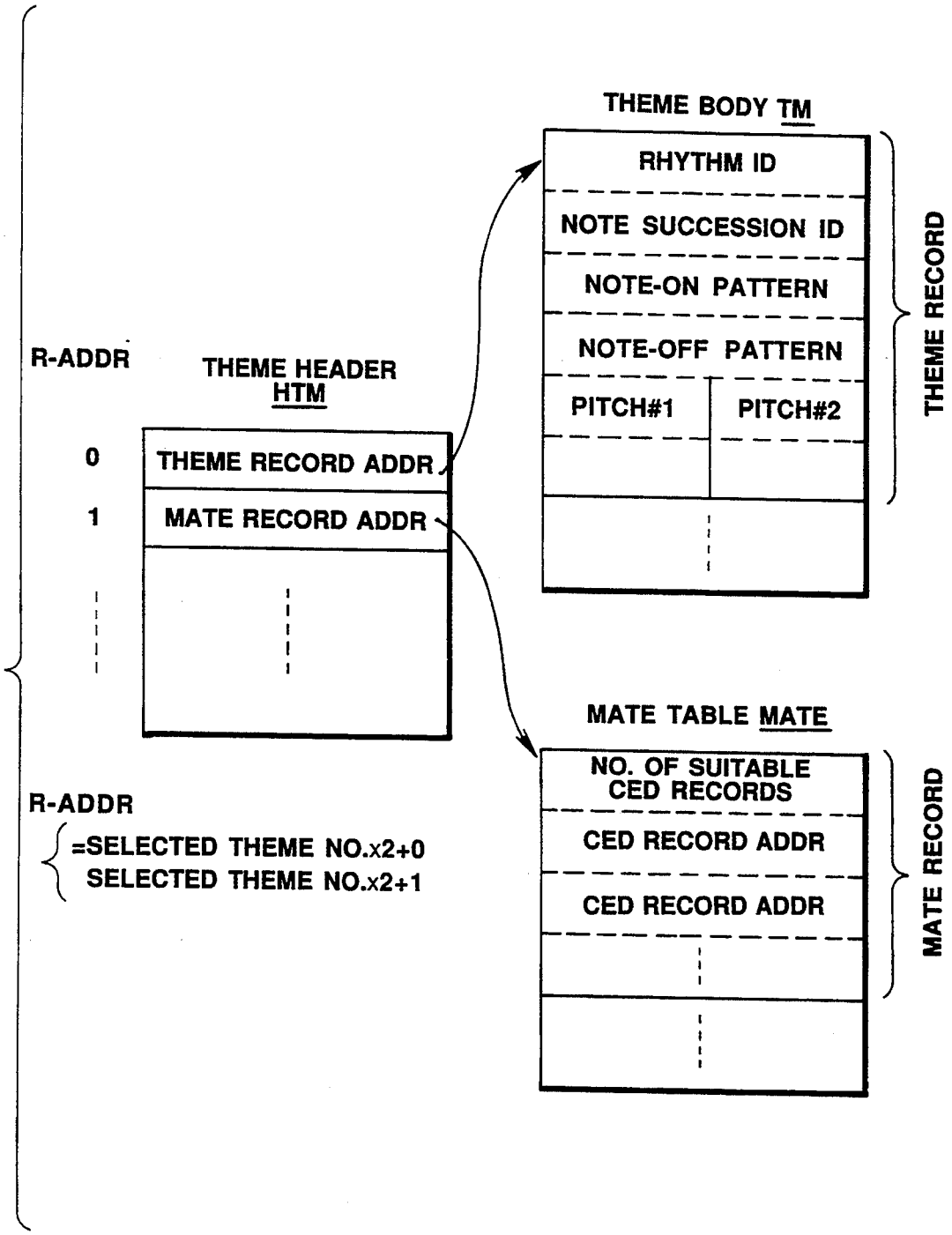
FIG. 30 shows a memory configuration of the theme table.

FIG. 30 illustrates a preferred memory configuration of the theme table or file TM. The theme table is formed by a theme header memory HTM, theme table body memory TM and mate table memory MATE. The theme header memory HTM is arranged such that an even numbered relative address stores an address of a theme record in the theme table body memory TM, whereas an odd numbered relative address stores an address of a mate record in the mate table memory MATE. A relative address space,of the theme header memory HTM is associated with a theme number selected by the theme select input device 28M. Specifically, (selected theme number (×2) yields the relative address in the theme header memory HTM, storing the theme record address of the selected theme. The next address in HTM stores the mate record address of the selected theme. Each theme record in the theme table body memory TM includes items of motive rhythm identifier (one word), motive note type succession identifier (one word), motive note-on pattern (one word), motive note-off pattern (one word), and pitches as many as the motive note number (one byte each). Each mate record in the mate table memory MATE includes items corresponding to numbers of CED records appropriate for the selected theme (one word) and each appropriate CED record address (one word each).

Figure 31:
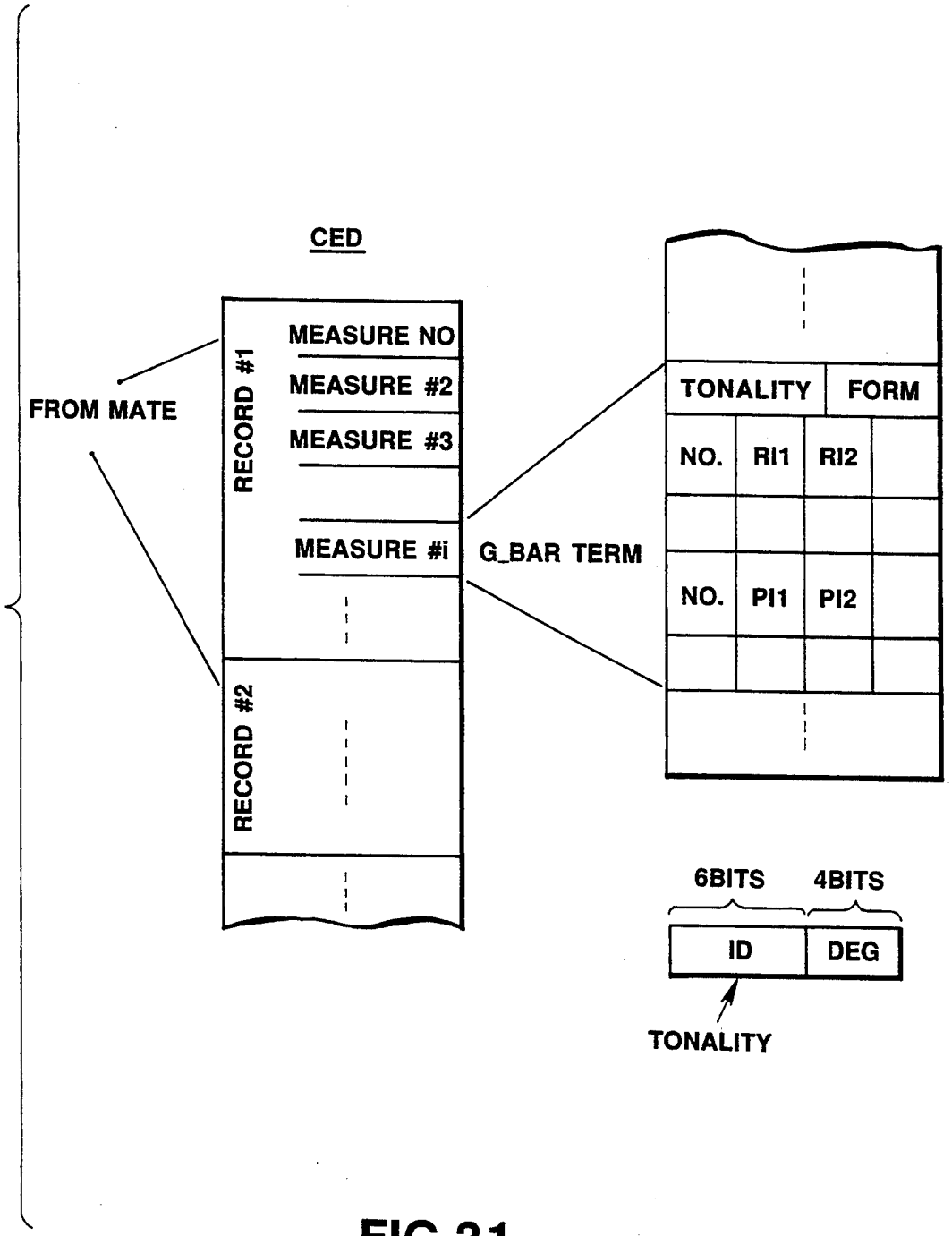
FIG. 31 shows a memory configuration of the generating index table.

FIG. 31 illustrates a preferred memory configuration of the melody generating index table CED. The addressing of the table memory CED is directly specified by a CED record address read from the mate table memory MATE. Each CED record (melody generating index record) in the table memory CED includes the items of measure number (one word) and phrase index term (G BAR term, measure term) for each measure. Each measure term has five words: The first word contains tonality index (10 bits) and form index (6 bits). The second and third words are assigned to rhythm index instance (candidate) group in which first 4 bits of the second word are assigned to the candidate number, and each following 4 bits are assigned to each rhythm index candidate RI1, RI2 ... as many as the candidate number. The fourth and fifth words are assigned to pitch index candidate group (in the same manner as the rhythm index candidate group) in which the first 4 bits in the fourth word are assigned to the pitch index candidate number, and each following 4 bits are assigned to each pitch index candidate PI1, PI2 ... as many as the candidate number. Thus, for each measure term, a rhythm index and pitch index each contain up to seven candidates.

Figure 32:
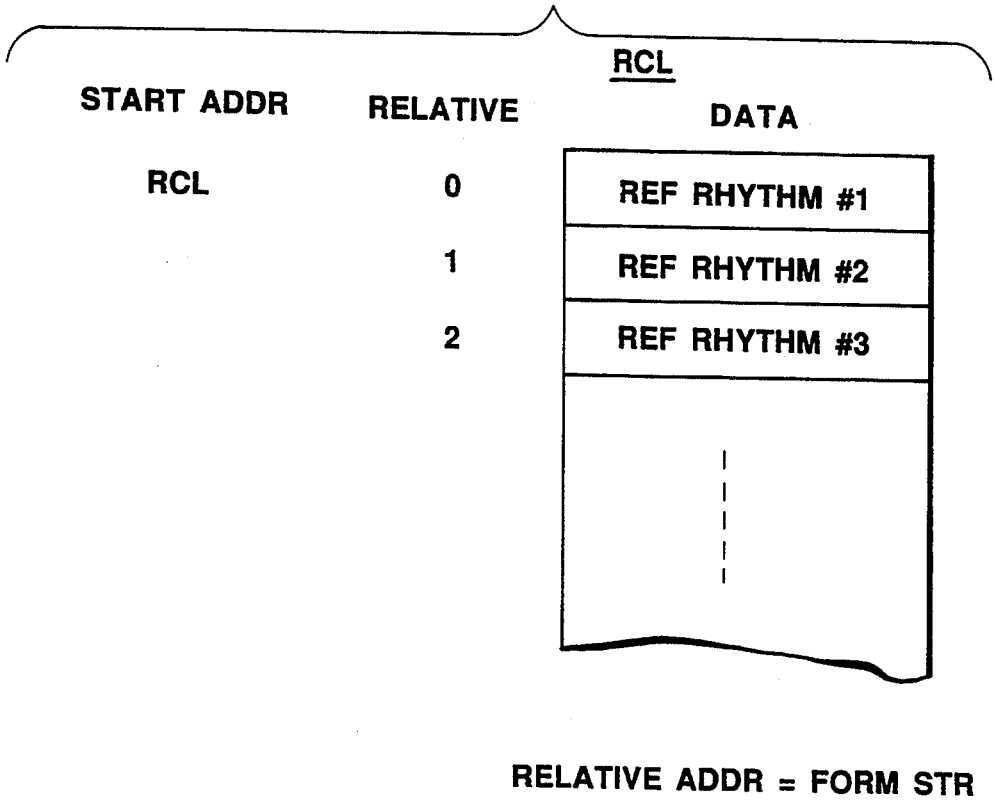
FIG. 32 shows a memory configuration of the reference rhythm table.

FIG. 32 illustrates the reference rhythm table memory RCL. A selected form index STR (retrieved from a G_BAR term shown in FIG. 31) specifies the relative address of record in the table memory RCL which stores an identifier of reference rhythm corresponding to the selected form index.

Figure 33:
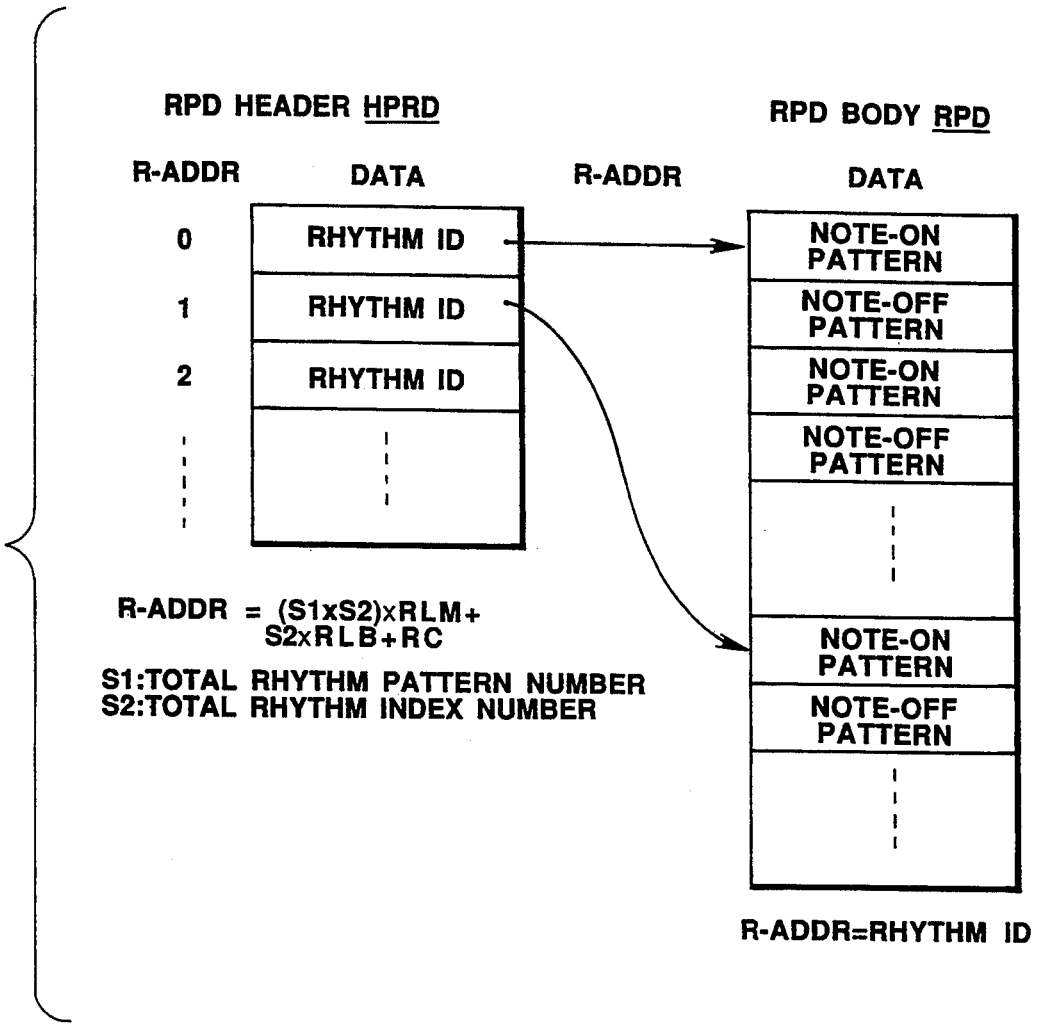
FIG. 33 shows a memory configuration of the rhythm table.

FIG. 33 illustrates a preferred memory configuration of the rhythm table RPD. The rhythm table is formed by a RPP header memory HPRD and a RPD body memory RPD. Each address in the RPP header memory HPRD stores a rhythm identifier which specifies a relative address of a rhythm data record in the body memory RPP. Each rhythm data record has two words stored in two consecutive addresses, one for a note-on pattern and the other for a note-off pattern. A relative address Of a rhythm identifier in the RPD header memory HPRD is given by:

$$\text{relative address}=(S1\times S2)\times RLM+S2\times RLB+RC$$

in which S1 is the total reference rhythm number and S2 is the total rhythm index number. Once rhythm table search arguments are given by a reference rhythm identifier RLM, last or previous measure rhythm identifier RLB, and current measure rhythm index RC, the rhythm identifier of the current measure rhythm corresponding to the argument combination is directly retrieved from the header memory HPRD by computing the relative address according to thee above formula. The retrieved rhythm identifier is then used to look up the data body table memory RPP to immediately retrieve the note-on and off patterns specifying the current measure rhythm. It is to be noted that different addresses in the RPD header memory HPRD can store same rhythm identifier. This means one-to-many correspondence between current measure rhythms and argument combinations of RLM, RLB and RC. Thus, the rhythm table memory configuration of FIG. 33 not only enables direct search of rhythm table but also saves the storage capacity.

Figure 34:
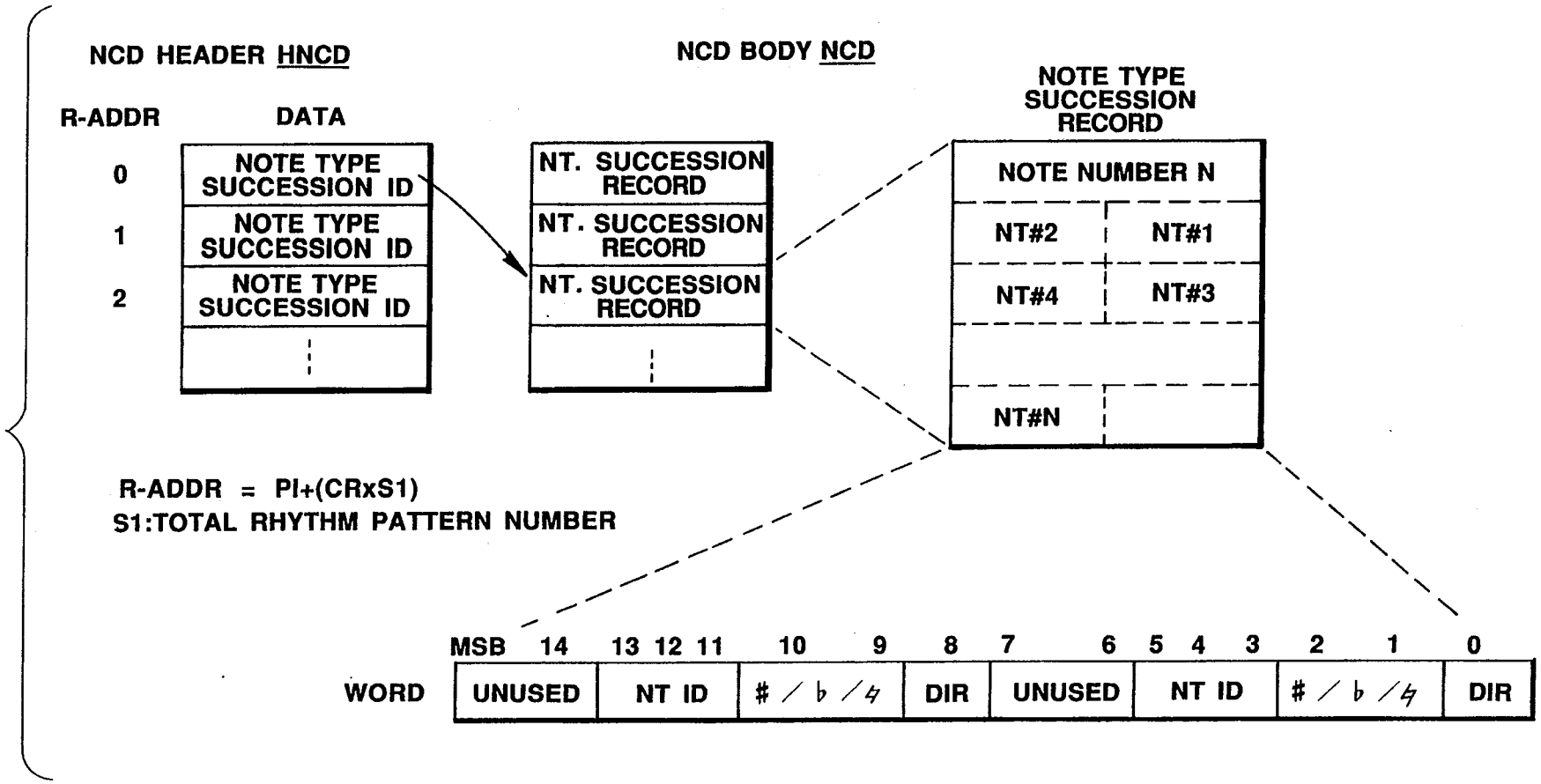
FIG. 34 shows a memory configuration of the note type succession table.
Figure 36:
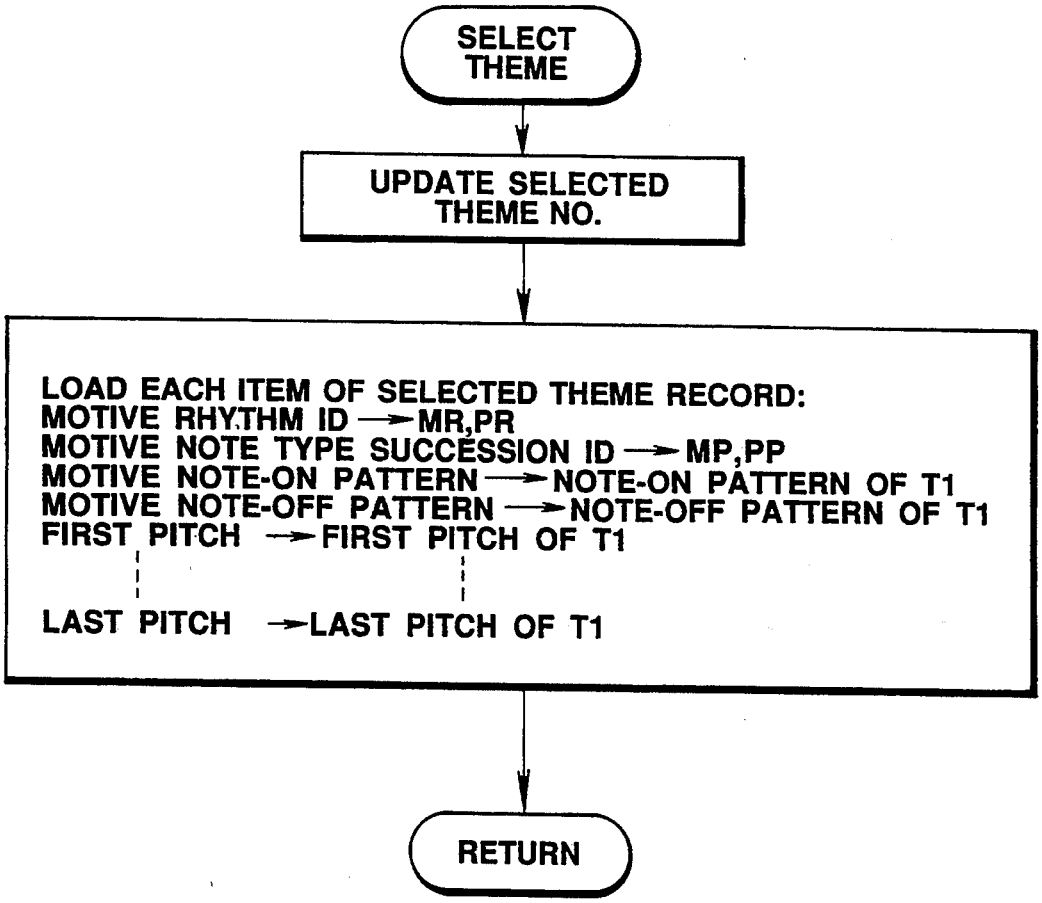
FIG. 36 is a flow chart of a select theme routine.
Figure 37:
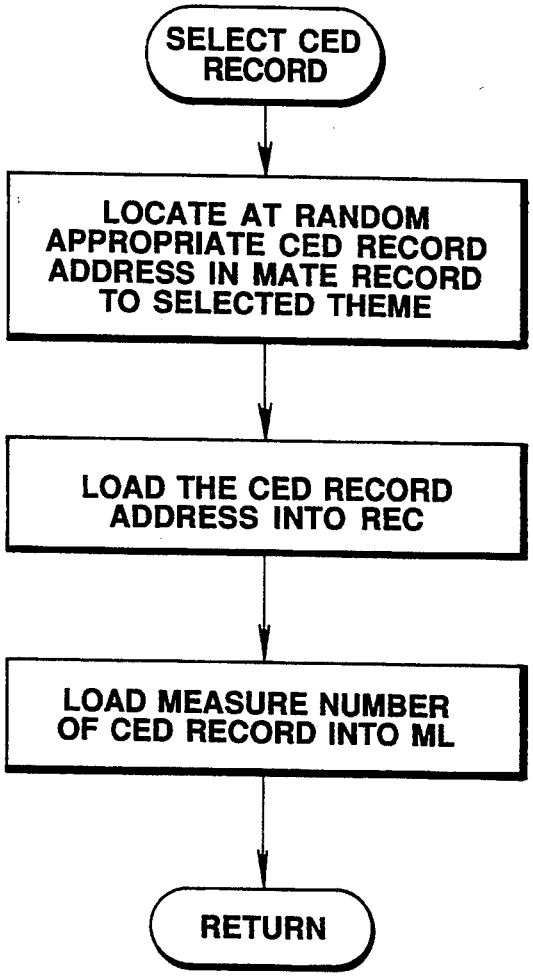
FIG. 37 is a flow chart of a select CED record routine.
Figure 38:
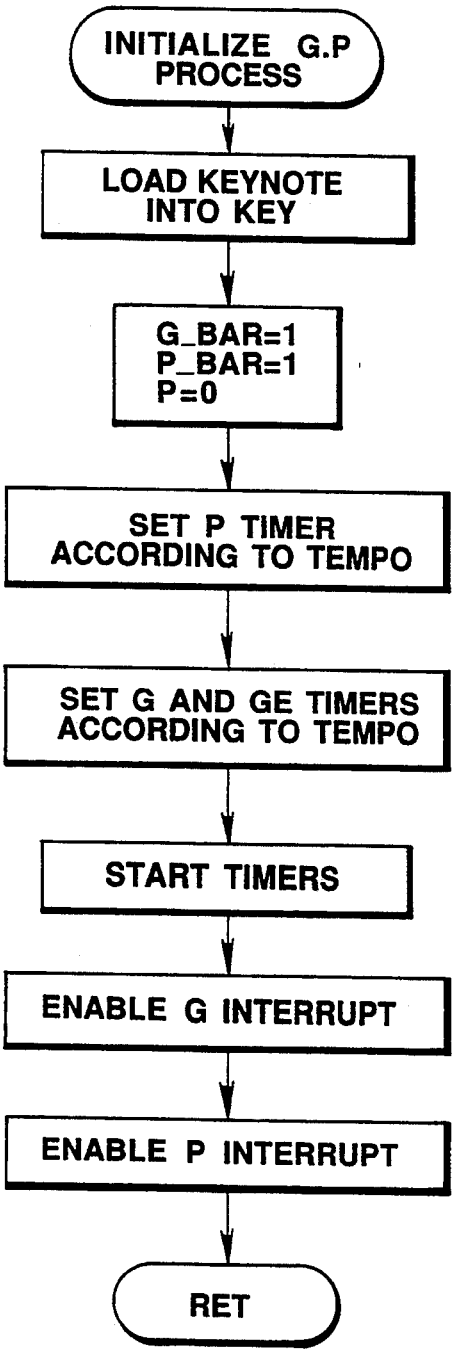
FIG. 38 is a flow chart of initialize G, P process routine.

FIG. 34 illustrates a preferred memory configuration for the note type succession table NCD. This table is structured by a NCD header memory HNCD and NCD body memory NCD. The NCD header memory HNCD stores a note type succession identifier at each address therein. Each note type succession identifier points to a note type succession record in the NeD body memory NCD. When the current measure rhythm identifier CR and the current measure pitch index PI are given, a relative address in the NCD header memory HNCD, storing the identifier of the current measure note type succession corresponding to the combination of CR and PI, is computed by:

$$\text{relative address} = PI + (CR \times S1)$$

in which S1 is the total rhythm pattern number. Thus, from the current measure rhythm identifier and pitch index, the corresponding note type succession record and identifier of the current measure is directly retrieved. Each note type succession record in the NCD body memory NCD includes the items of note number (one word) and a corresponding number of note types (one byte each) comprising the note type succession. Thus, one word of note type contains two note types as illustrated in the bottom of FIG. 34. Each note type item has the fields of direction flag (DIR), accidental (#/λ/μ) and identifier (NT ID). The direction flag indicates whether the note type is higher (+) or lower (−) than the reference pitch. The note type identifier represents one of the note types which is either first chord member (NT ID=0), second chord member (=1), third chord member (=2), fourth chord member (=3), second scale note (=4), fourth scale note (=5), or sixth scale note (=6). The accidental flag is used to raise or lower the pitch of note type by semitone.

FIG. 35 illustrates the pitch class (PC) translation table memory configuration. Each seven consecutive words or addresses in the PC translation table memory AV store a PC record corresponding to one of tonality identifier instances. Thus, when the current measure tonality identifier TONAL is Given from CED record, (7×TONAL) specifies the relative address of the PC record corresponding to TONAL. In each PC record in the memory AV, the first word contains pitch class data of the first chord member k1, second word contains pitch class data of the second chord member k2, third word contains pitch class data of the third chord member k3, fourth word contains pitch class data of the fourth chord member k4, fifth word contains pitch class data of the second scale note st2, sixth word contains pitch class data of the fourth scale note st4, and seventh word contains pitch class data of the sixth scale note st6.

Figure 39:
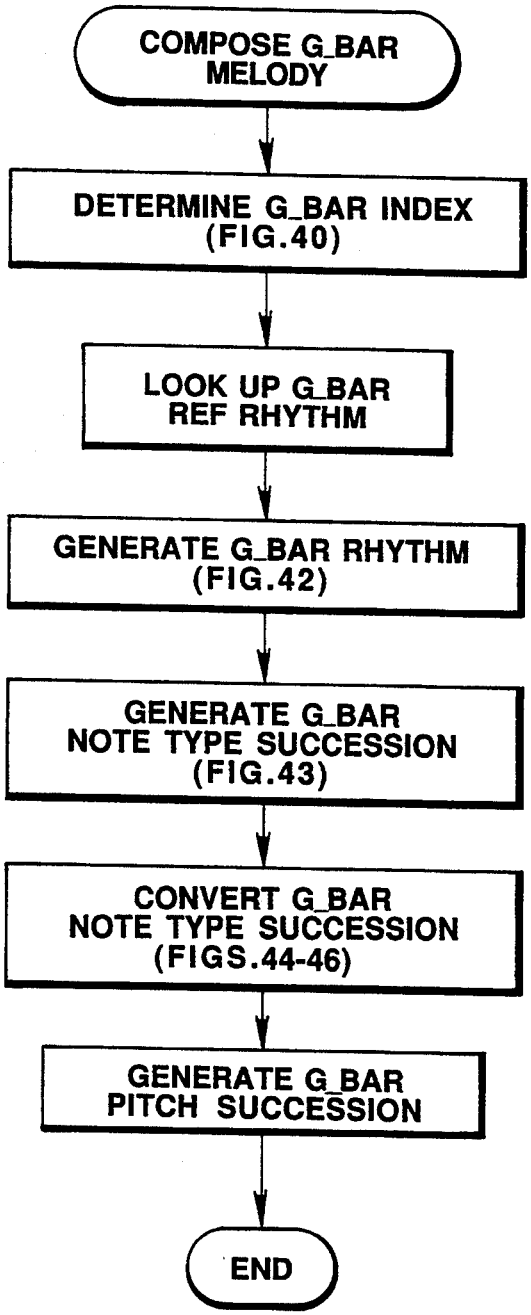
FIG. 39 is a flow chart of a compose G_BAR melody routine.
Figure 40:
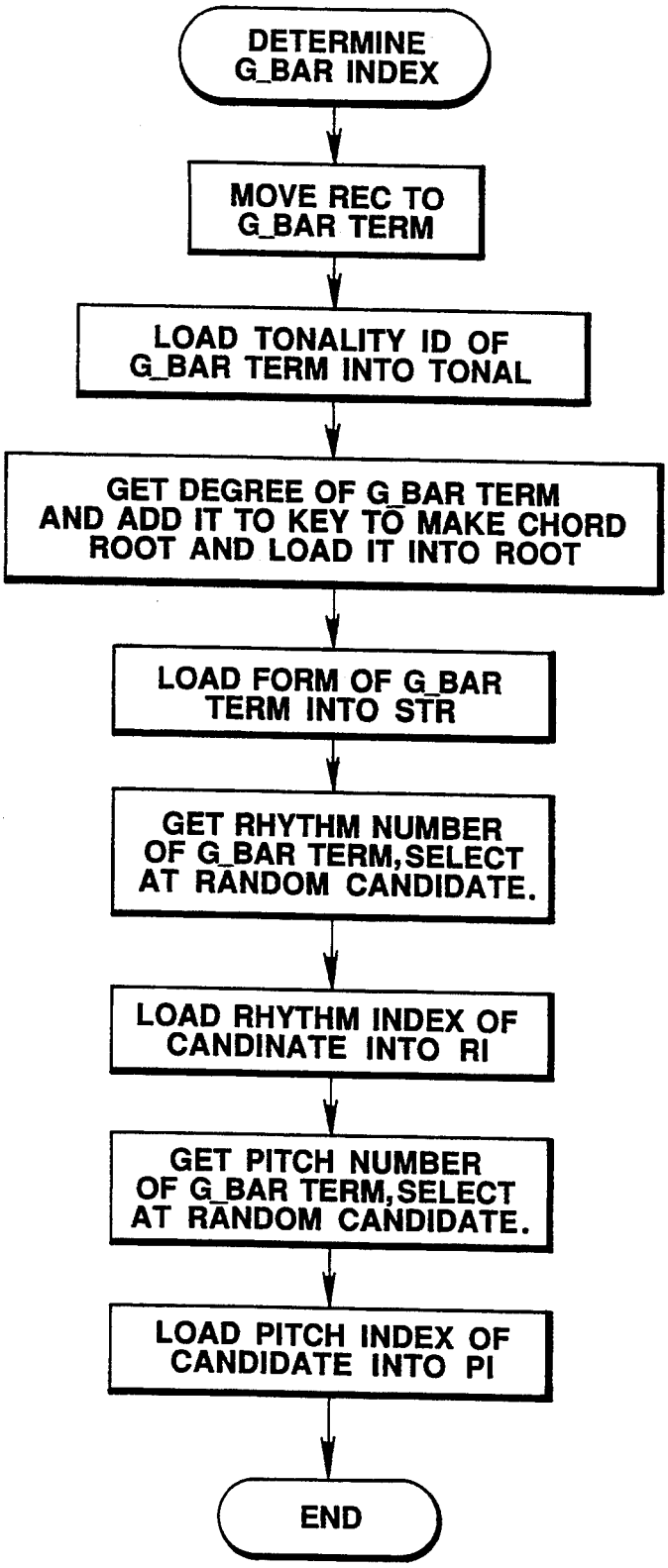
FIG. 40 is a flow chart of a determine G_BAR index routine.
Figure 41:
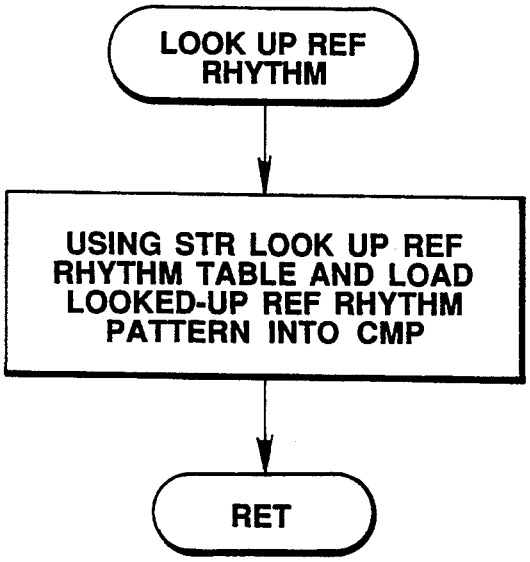
FIG. 41 is a flow chart of a look up reference rhythm routine.
Figure 42:
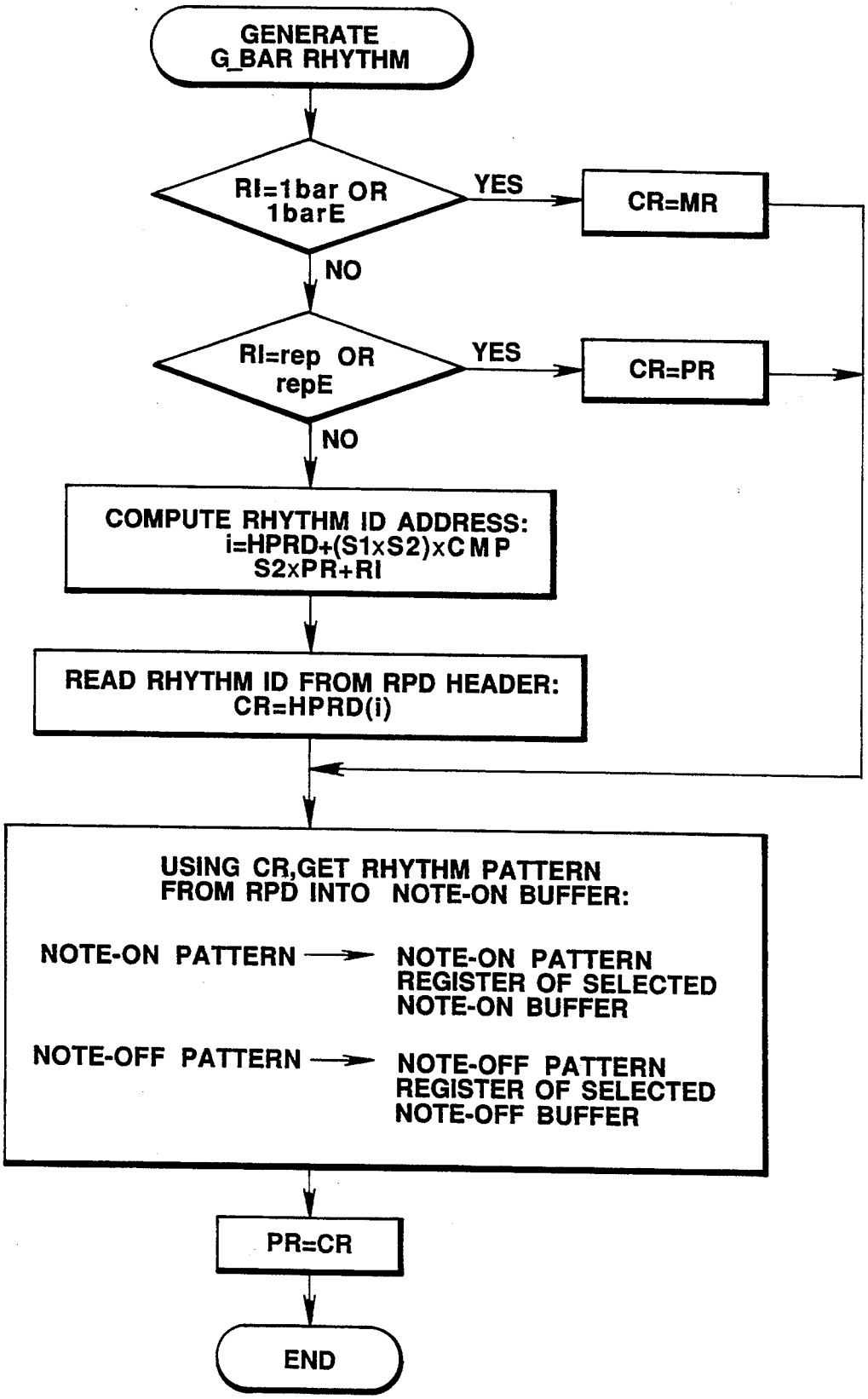
FIG. 42 is a flow chart of a generate G_BAR rhythm routine.
Figure 43:
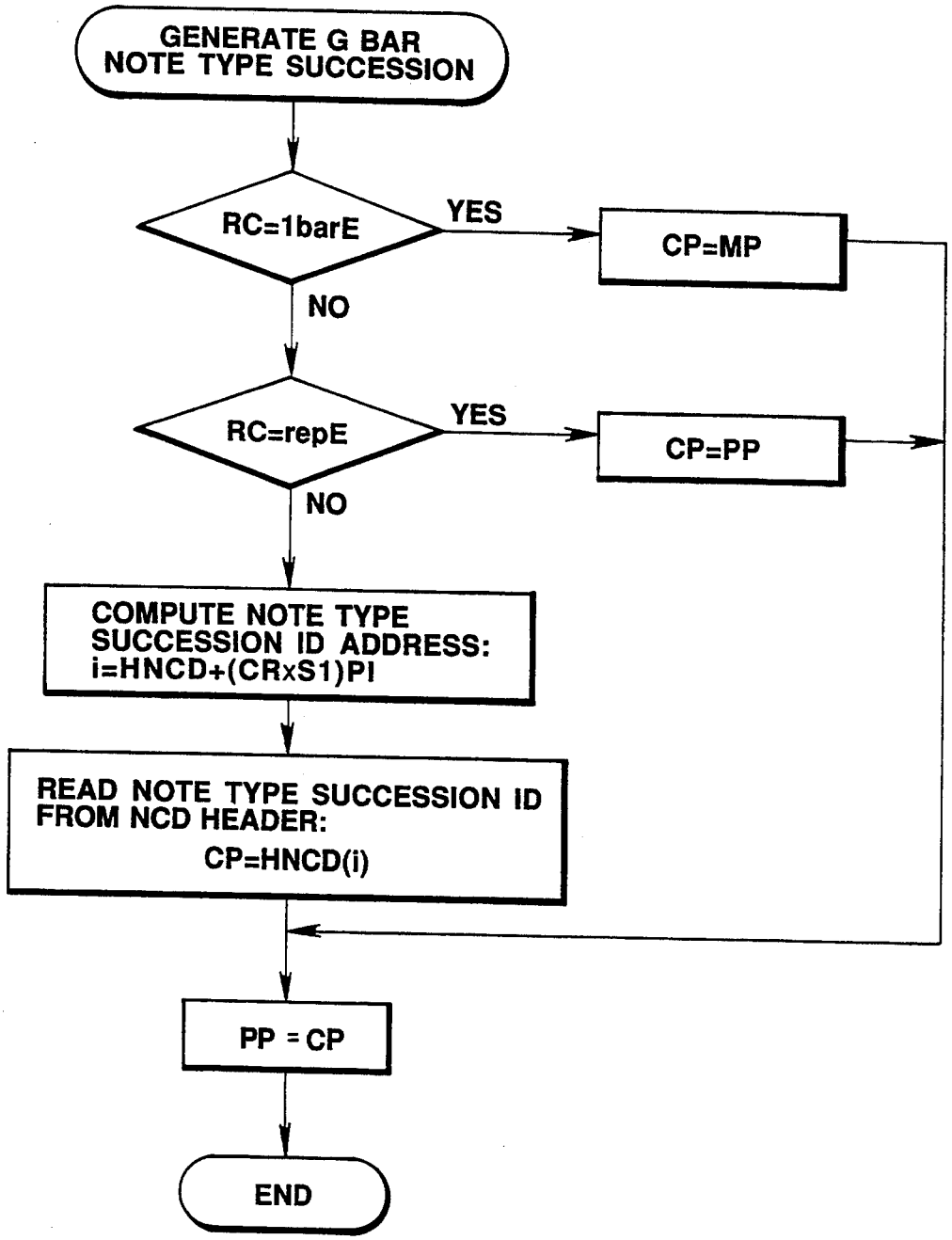
FIG. 43 is a flow chart of a generate G_BAR note type succession routine
Figure 44:
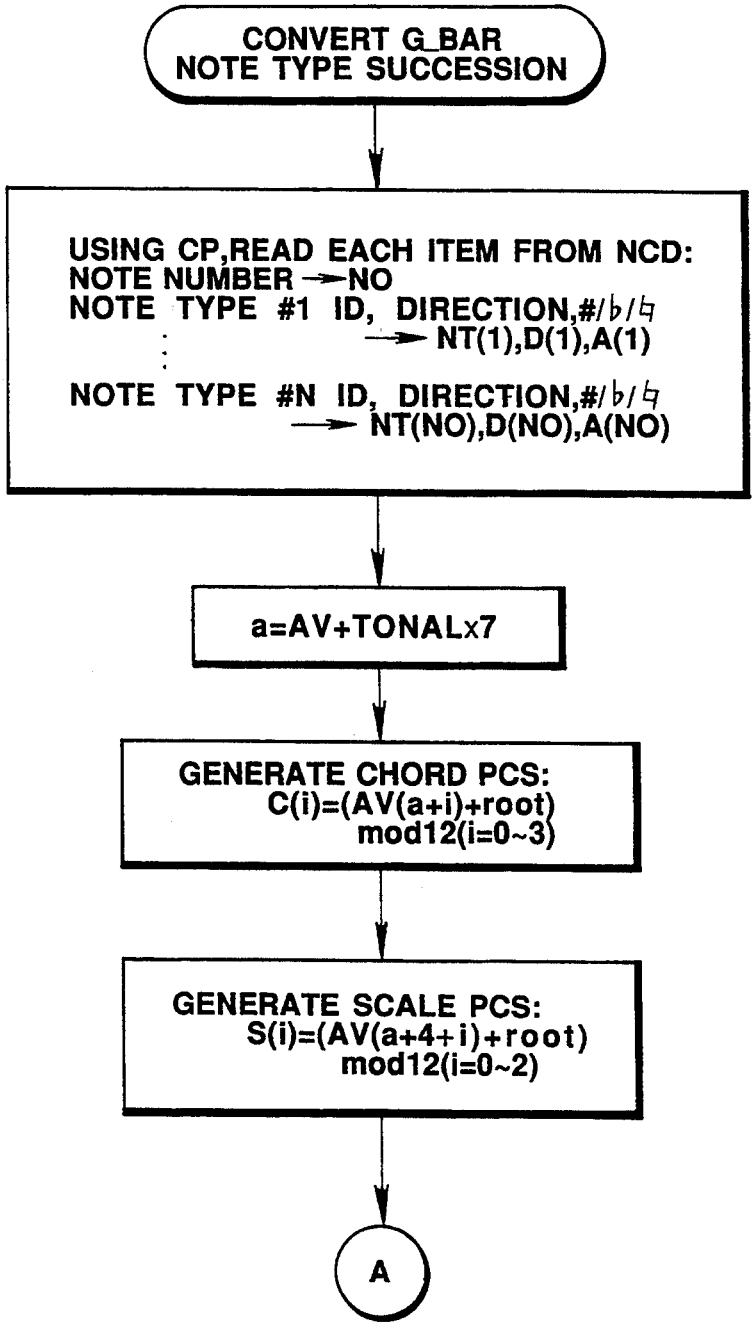
FIGS. 44–46 are flow charts of a convert G_BAR note-type succession routine.
Figure 45:
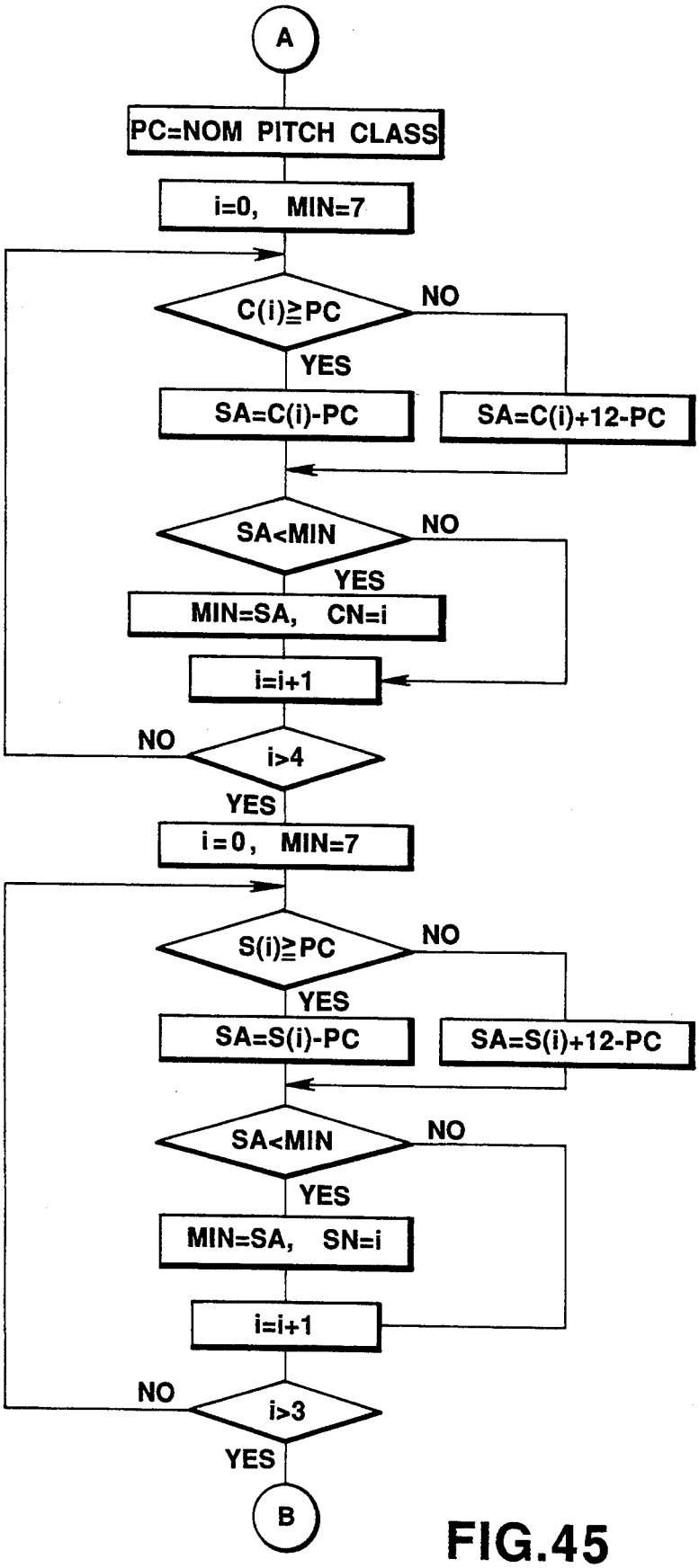
Figure 46:
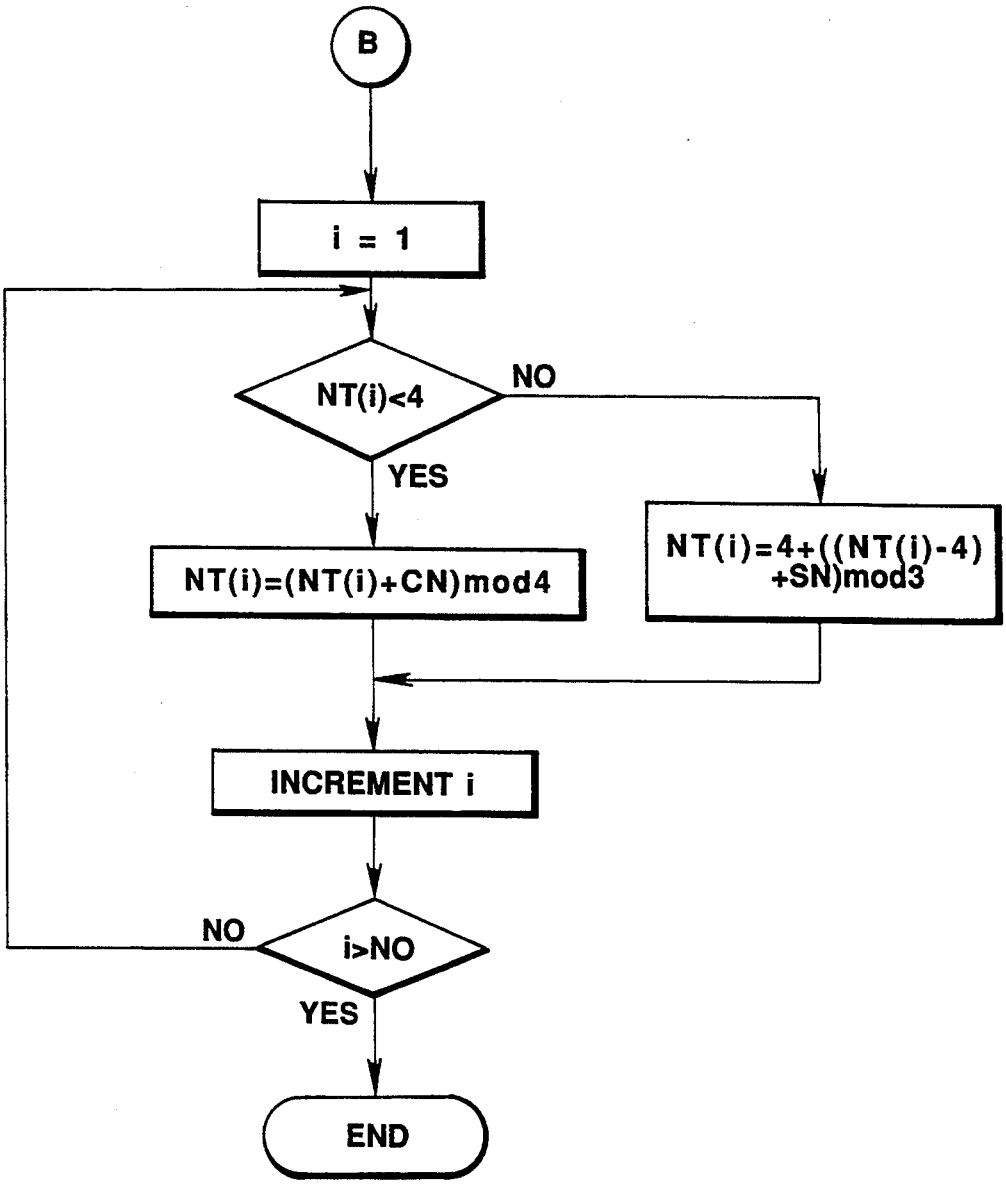
Figure 47A:
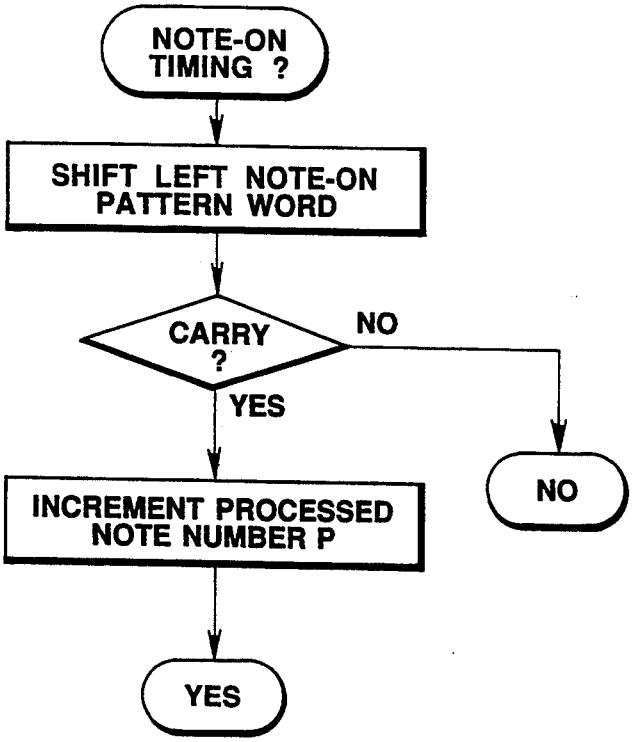
FIGS. 47A–47C are flow charts of note-on timing, note-on process and note-off process routines, respectively.
Figure 47B:
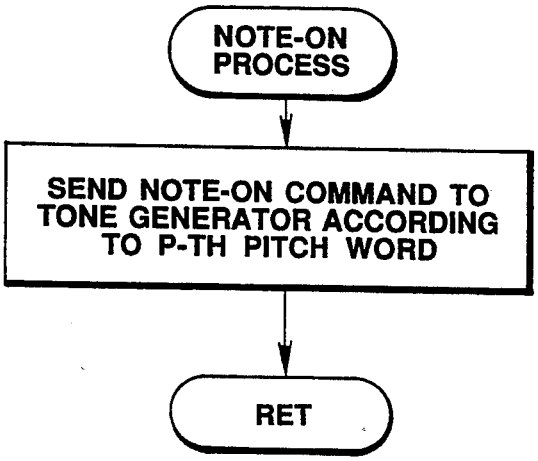
Figure 47C:
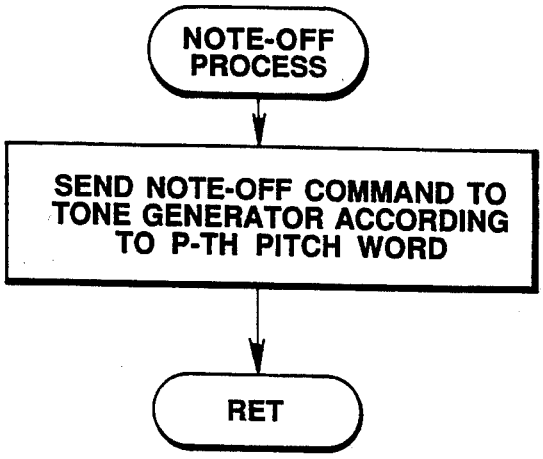

FIGS. 36 to 47A–C show detailed flow charts of individual routines. In particular, FIGS. 36, 37, and 38 detail the select theme routine or block 25-5, the select CED record block 25-6, the initialize G, P process block 25-7, respectively, of the main process (FIG. 25). FIG. 39 details the compose G_BAR melody block 26-5 of G interrupt process (FIG. 26). The first block "determine G_BAR index" of the compose G_BAR melody (FIG. 39) is detailed in FIG. 40. The second block "look up G_BAR ref rhythm" in the flow of FIG. 39 is detailed in FIG. 41. The details of the third block "generate G_BAR rhythm" are shown in FIG. 42. The fourth block "generate G_BAR note type succession" is detailed in FIG. 43. The details of the fifth block "convert G_BAR note type succession" are shown in FIGS. 44 to 46. FIG. 47A details the note-on timing? step 27-1 of P interrupt process (FIG. 27). FIG. 47B details the note on process step 27-2 (FIG. 27). FIG. 47C details the note off process step 27-4 (FIG. 27). Further descriptions of these flow charts of FIGS. 36 to 47A–C are omitted, since the function and operation thereof are clear from the descriptions or indications in these figures per se and the foregoing description of the first and second embodiments.

The description of the first embodiment has focused on the automatic melody composing technique utilizing and supported by the music database. As having been apparent, the present automatic melody composer composes a melody on a phrase by phrase basis. A phrase as composing unit is generated by selecting and combining (composing) phrase components in the phrase database according to the phrase generating index. This approach assures naturalness in the composed phrase. Further, the phrase development, modification and repeat are desirably controlled by the generating index. An aspect of the generating index information is a descriptor for the phrase database, indicating how to develop, modify or repeat a given theme motive and/or directing a new motive different from the theme motive. Thus, the present automatic melody composer has the advantage over the prior art with respect to the capability of providing a wide variety of melodies involving satisfactory musicality and with respect to prompt composing feature according to data retrieval-based melody composing method.

The description of the second embodiment has focused on the real-time control system which enables or facilitates the real-time response performance of a music apparatus such as automatic melody composer, when implemented on a computer system having a single CPU. The present real-time control system has a wide application including a musical apparatus other than the database-oriented automatic melody composer. With the present control system, an automatic melody composer which requires a couple of seconds to compose a one-measure melody can provide real-time composing and playing of a melody, however long it is.

Modifications

In the shown and described embodiments, the music database ( generating index table, theme bank, phrase database ) reside in the internal memory ROM of the music apparatus. If desired, an external memory device such as CD ROM may be used to supply a desired music database. The external memory device may store a plurality of music databases classified according to musical styles. In operation, a desired music data set in the external memory is loaded into the internal RAM memory of the music apparatus which then compose a melody based on the loaded data set. For example, when a music style is specified by a style selector, the music apparatus loads a music data set (e.g., phrase database) pertaining to the specified music style into the internal RAM memory from the external CD ROM to enable the automatic melody composing system to compose a melody according to the specified style.

In a simple arrangement of the present automatic melody composer, the phrase database takes the form of a database of phrase patterns in which each phrase pattern record contains a rhythm and a pitch succession. A melody generating index directs how to chain which phrase patterns into a melody. The generating index table CED contains a multiplicity of phrase generating index records, each as information processing unit. Each phrase generating index record contains (a) its name (the index identifier) and (b) several candidates for the next phrase in which each candidate entry contains a phrase pointer pointing to one of the phrase pattern records in the phrase database and an index identifier pointing to a phrase generating index record in the generating index table CED. Some candidates may contain a command indicative of end of melody. In operation, the automatic melody composer retrieves a phrase generating record from the table CED. Then it selects at random one of the candidates contained therein. The automatic melody composer uses the phrase pointer of the selected candidate to retrieve a corresponding phrase pattern from the phrase database and pass it to the automatic melody performing system. Also the automatic melody composer uses the index identifier set forth in the selected candidate entry to retrieve a next phrase generating index record from the table CED to thereby repeat the process. This arrangement thus provides desired control of phrase development and modification. The automatic melody composer may further include a monitoring means which monitors the succession of the selected phrase pointers or identifiers to detect when it matches a cadence pattern which causes the automatic melody composer to finish the melody composing or start a new melody sentence or period. In this regard, a sentence start table may be provided. Each record in the sentence start table contains (a) a pattern of phrase identifiers representing a cadence (authentic, half or deceptive), used as search keyword and (b) candidates for the new sentence starting phrase in which each candidate contains a generating index identifier and a phrase identifier. The monitor means matches a succession of phrase identifiers selected for melody composition against each search keyword. If matched, the monitor means selects at random one of the candidates in the matched record, retrieves from the phrase database a phrase pattern record specified by the phrase identifier of the selected candidate, passes the retrieved phrase pattern to the automatic melody performing system, and uses the index identifier in the candidate to access to generating index table CED. A candidate may be a command which directs finishing the melody composing. In this manner, the generating index table CED realizes a network of phrase generating index records arranged to provide large collections of melody (phrase succession) generating indexes.

In another arrangement of the automatic melody composer, the phrase database memory stores a plurality of phrase records, each having a note type succession and a rhythm. The table CED is identical with the one described above. When a tonality succession is supplied externally, the automatic melody composer translates the note type succession into a pitch succession based on the current tonality. Such tonality succession may be derived from a chord progression played by the user from the keyboard. Thus, the automatic melody composer composes and plays a melody in real time in response to a chord progression entered in real time by the user.

The invention may further provide an automatic melody composer which composes a melody in response to a theme manually played by the user. To this end, the automatic melody composer includes a matching means which matches the played theme against stored themes in the theme bank memory. A stored theme most matching the played theme is selected. Thereafter, the automatic melody composes a melody in the manner as described with respect to the embodiment.

Therefore, the scope of the invention should be limited solely by the appended claims.

What is claimed is:

1. An automatic melody composer for composing a melody on a phrase by phrase basis wherein the melody extends over a plurality of musical time units, and wherein the term phrase refers to a melody segment in an individual musical time unit, comprising:

phrase database means for storing a database of phrases in terms of musical components of phrase;

generating index storage means for storing generating indexes of phrases in individual musical time units, arranged so as to control a melody extending over a plurality of musical time units; and decoding means for applying a generating index from said generating index storage means to said phrase database means to thereby decode said generating index into a phrase.

2. The automatic melody composer of claim 1 wherein said phrase database means comprises:

rhythm storage means for storing a database of rhythms as a first component of a phrase; and note type succession storage means for storing a database of note type successions as a second component of a phrase.

3. The automatic melody composer of claim 2 wherein said decoding means comprises associating means for associating rhythms stored in said rhythm storage means with note type successions in said note type succession storage means in order that a rhythm and a note type succession associated therewith may be composed into a phrase.

4. The automatic melody composer of claim 2 wherein said decoding means comprises retrieving means for retrieving, from said note type succession storage means, a note type succession of a phrase in a current musical time unit according to a pitch change index of said phrase, as an item of said generating index, and according to a rhythm of said phrase retrieved from said rhythm storage means.

5. The automatic melody composer of claim 2 wherein said decoding means comprises pitch translating means for translating a note type succession from said associated note type succession into a pitch succession according to a tonality index as an item of said generating index.

6. The automatic melody composer of claim 5 wherein said pitch translating means includes pitch range adjusting means for adjusting a pitch range of a pitch succession of a phrase in a current musical time unit to that of a pitch succession of a phrase in a last musical time unit.

7. The automatic melody composer of claim 1 wherein said generating index includes items of tonality index, pitch change index and rhythm index.

8. An automatic melody composer comprising:

theme setting means for setting a theme; and phrase-by-phrase composing means for composing a melody following a theme as a motive on a phrase by phrase basis, wherein the term phrase refers to a melody segment in an individual musical time unit;

wherein said phrase-by-phrase composing means comprises:

generating index table storage means for storing a plurality of generating indexes of phrases, associatable with themes;

phrase database storage means for storing a phrase database in the form of phrase components which are associatable with said generating indexes and combinable into various phrases;

selecting means responsive to said theme setting means for selecting, from said generating index table storage means, a generating index associated with said theme set by said theme setting means;

phrase generating means responsive to said selecting means for retrieving phrase components from said phrase database storage means according to said selected generating index and for combining said retrieved phrase components into a phrase.

* * * * *